US006065848A

United States Patent [19]

Tucker et al.

[11] Patent Number: 6,065,848

[45] Date of Patent: May 23, 2000

[54] BASE FOR ILLUMINATING THE INTERIOR OF A CONTAINER

[75] Inventors: Gale F. Tucker, Incline Village, Nev.; Ronald L. Schoelkopf, White Hall, Md.; Jerry L. Rosow, Naples, Fla.; David L. Hector, Englewood, Colo.

[73] Assignee: Progessive Specialty Glass Company, Inc., Southington, Conn.

[21] Appl. No.: 08/870,179

[22] Filed: Jun. 6, 1997

[51] Int. Cl.[7] ..... F21V 33/00

[52] U.S. Cl. ..... 362/101; 362/806

[58] Field of Search ..... 362/101, 253, 362/806

[56] References Cited

U.S. PATENT DOCUMENTS

| | | | |
|---|---|---|---|
| D. 377,738 | 2/1997 | Thorne | D7/536 |
| 919,691 | 4/1909 | Cahill | 362/101 |
| 2,224,329 | 12/1940 | Schoyer | 362/101 |
| 2,532,181 | 11/1950 | Moore | 362/101 |
| 2,663,866 | 12/1953 | Simpson | 362/101 |
| 2,745,947 | 5/1956 | Sansous | 362/101 |
| 3,218,447 | 11/1965 | Pardue | 362/101 |
| 3,374,344 | 3/1968 | Rudolph et al. | 362/101 |
| 3,735,113 | 5/1973 | Scott | 362/101 X |
| 3,834,351 | 9/1974 | Schmidt | 119/5 |
| 3,878,386 | 4/1975 | Douglas | 362/101 |
| 4,034,213 | 7/1977 | Norris | 362/101 X |
| 4,072,855 | 2/1978 | Marchee | 362/101 |
| 4,261,026 | 4/1981 | Bolha | 362/101 |
| 4,336,574 | 6/1982 | Goodman | 362/101 |
| 4,344,113 | 8/1982 | Ditto et al. | 362/101 |
| 4,390,928 | 6/1983 | Runge | 362/101 |
| 4,563,726 | 1/1986 | Newcomb et al. | 362/101 X |
| 4,858,084 | 8/1989 | Sheryll | 362/101 |
| 4,922,355 | 5/1990 | Dietz et al. | 362/101 |
| 5,010,461 | 4/1991 | Saotome | 362/101 |
| 5,070,435 | 12/1991 | Weller | 362/101 |
| 5,119,279 | 6/1992 | Makowsky | 362/101 |
| 5,178,450 | 1/1993 | Zelensky et al. | 362/101 |
| 5,211,699 | 5/1993 | Tipton | 362/101 |
| 5,307,250 | 4/1994 | Pearson | 362/101 |
| 5,339,548 | 8/1994 | Russell | 362/101 X |
| 5,504,663 | 4/1996 | Tucker | 362/101 |
| 5,575,553 | 11/1996 | Tipton | 362/101 |
| 5,624,177 | 4/1997 | Rosaia | 362/101 |
| 5,743,620 | 4/1998 | Rojas et al. | 362/101 |

FOREIGN PATENT DOCUMENTS

| | | |
|---|---|---|
| 672273 | 2/1939 | Germany . |
| 2 731 363 | 1/1979 | Germany . |

*Primary Examiner*—Laura K. Tso
*Attorney, Agent, or Firm*—Ohlandt, Greeley Ruggerio & Perle, LLP

[57] ABSTRACT

A base, for use with and for illuminating the interior of a container for liquids, and which has a bottom wall portion at least partly transparent to light, comprising a main body comprised of an upwardly-disposed side wall whose height is substantially less than that of the container, a bottom wall adapted to carry, or having holder structure for holding, at least one battery in a substantially horizontal position, a mount for a light bulb, electrical conductors and support structure for supporting a container thereon, to illuminate the interior of a container supported on the base through the container bottom wall portion. The base can include securement structure for securing the base to the container to reside under its bottom end portion so that when the container is lifted, the base is lifted with the container.

84 Claims, 14 Drawing Sheets

FIG. 15
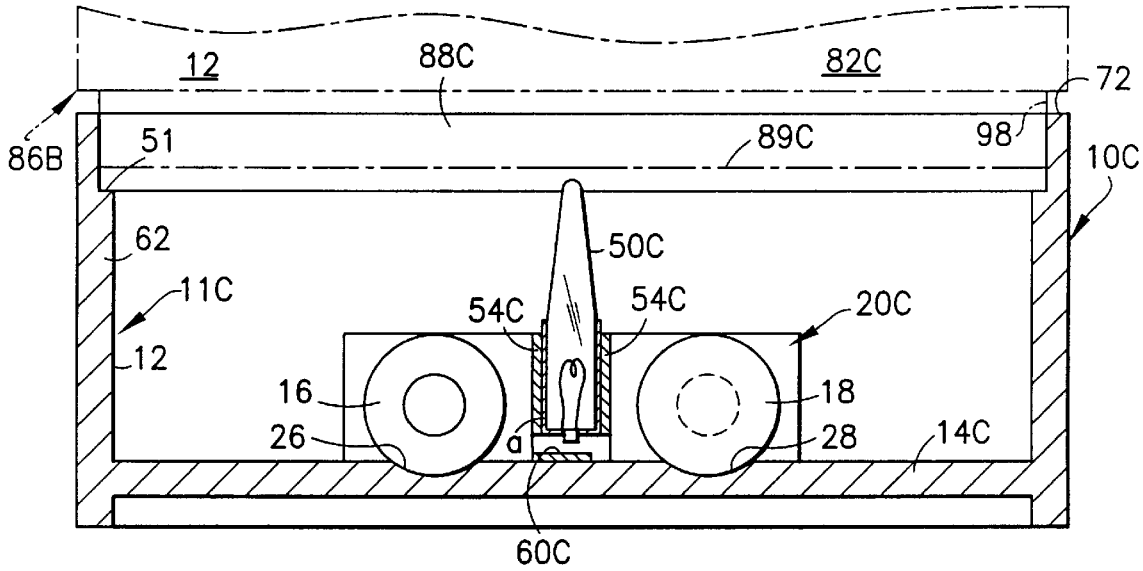
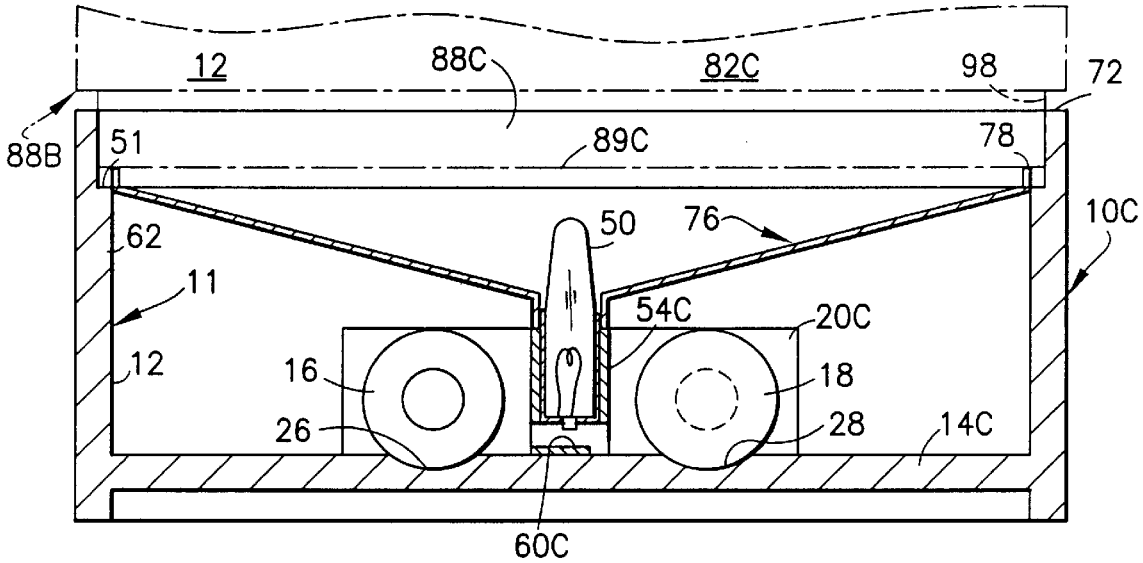
FIG. 16
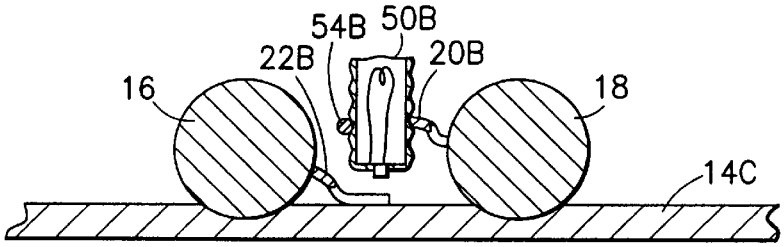
FIG. 17

FIG. 18
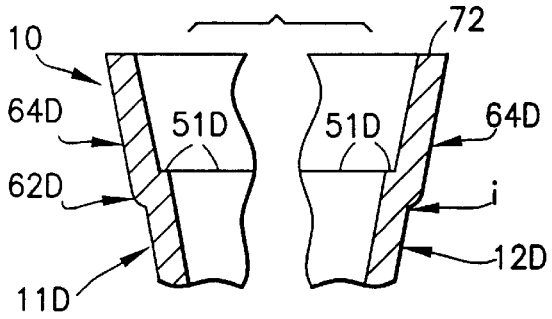
FIG. 19
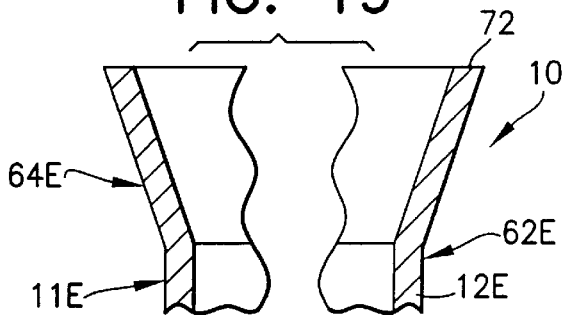
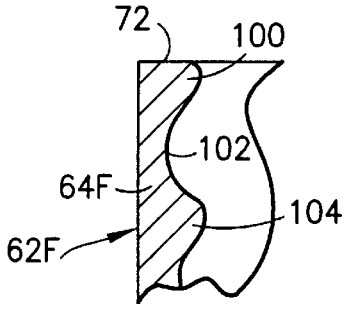
FIG. 20
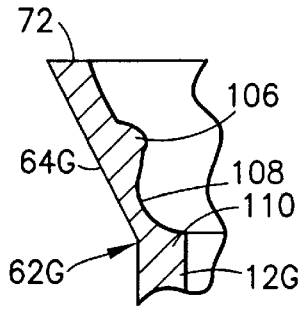
FIG. 21
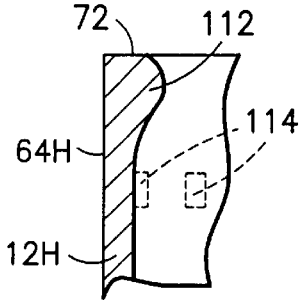
FIG. 22
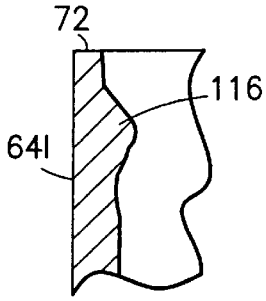
FIG. 23

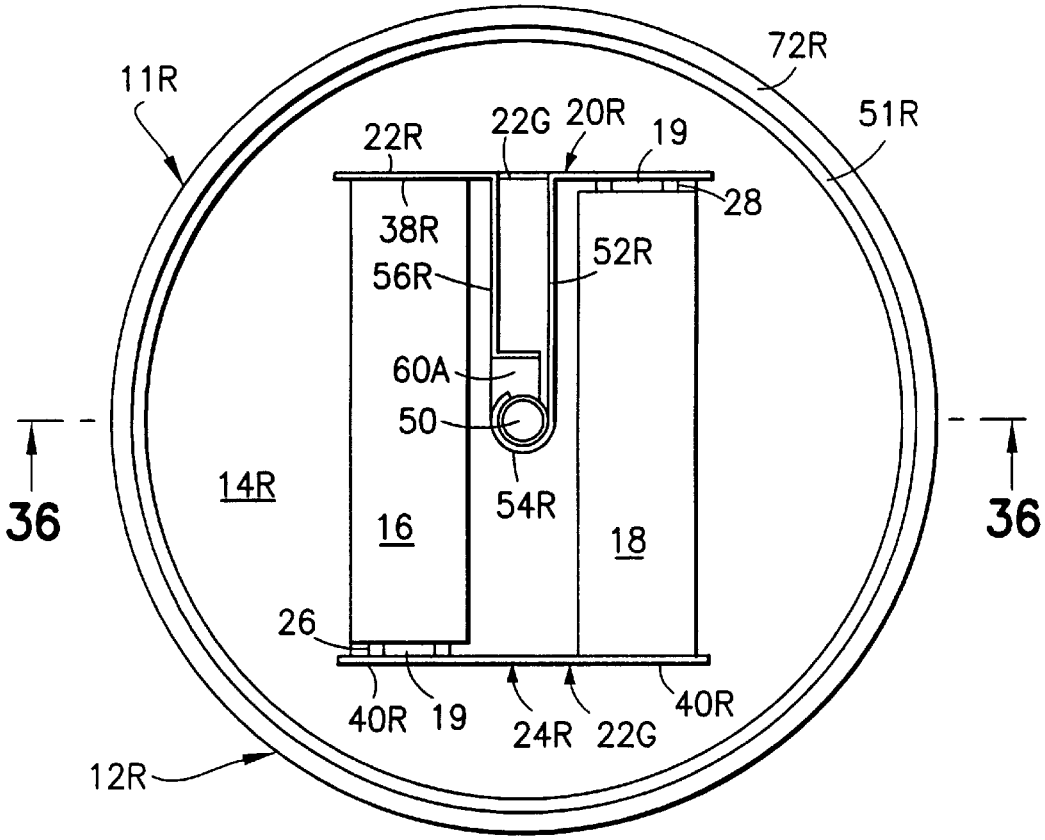
FIG. 35
FIG. 36
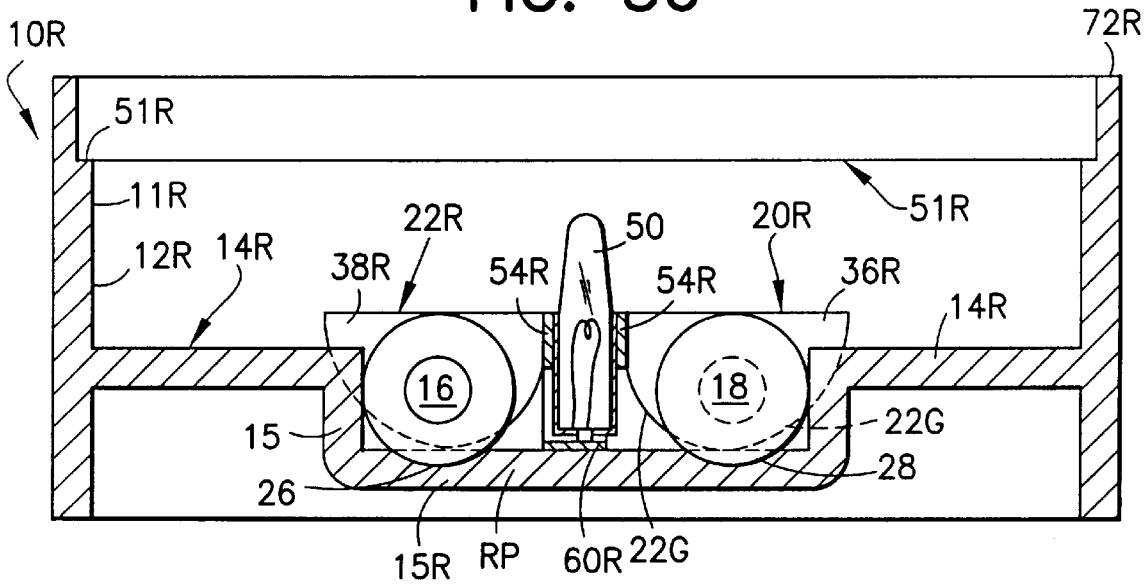

BASE FOR ILLUMINATING THE INTERIOR OF A CONTAINER

BACKGROUND OF THE INVENTION

This invention relates to containers for holding liquids and having means for illuminating the liquids.

Drinking containers are well known. Sources of light of various types, for example, combinations of batteries and light bulbs with conductors therebetween, are also well known. Drinking containers having such sources of light associated therewith for illuminating the liquids held in containers are disclosed in U.S. Pat. No. 5,504,663, assigned to the assignee of this invention, and whose disclosure is incorporated herein by reference. The patent discloses drinking containers an means for holding a light source or lighting device to illuminate the interior of the container. The holding means can be associated with any suitable portion of the container, for example, the container's closure, a container handle, or the container bottom or an extension thereof, for example a base portion integral with or connected to the bottom. The holding means can be of any suitable shape, configuration dimension or position, and the container or light source can have a flexible or moveable portion which can be moved to activate the light source. The patent discloses several embodiments wherein the container bottom wall or base portion includes the holding means which comprises a housing for holding the light source in place. Other patents which disclose a light source associated with a drinking container are U.S. Pat. Nos. 5,178,450, 2,224,319 and German Patent Schrift 672,273, the first disclosing a light source in a lid, and the latter two disclosing an elongated vertically-disposed hollow neck which forms the housing which holds the light source. In each case the light source held in the elongated vertical neck is a single vertically-disposed elongated battery having a vertically-disposed light bulb directly contacting the top end of the battery. Each elongated vertical housing has a platform to stabilize the vertical neck.

It would be desirable to have containers for liquids, especially drinkable liquids including water, soda and alcoholic beverages, wherein the container bottom or bottom end portion or an extension thereof such as a separate base portion includes the light source for illuminating the interior of the container.

It therefor is an object of this invention to provide containers for liquids having a base which is adapted to contain a light source and is relatively easy and economical to manufacture.

Another object of this invention is to provide a base adapted to be secured or connected to and/or support or be used with a drinking container which has a transparent bottom portion or bottom wall portion, wherein the base does not have an elongated vertically-extending neck or portion under the container to house a light source, or a wide platform or foot to attempt to stabilize the elongated neck on a surface.

Another object of this invention is to provide an aforementioned or other desired base for a container for liquids wherein the base is short in height relative to the height of the container with which it is used.

Another object of this invention is to provide an aforementioned desired short base for a drinking container, wherein the base portion holds one or more batteries in a substantially horizontal position and one or more light bulbs in an upright position to illuminate the interior of the container.

Another object of this invention is to provide an aforementioned base for a container for liquids wherein the base is easy to assemble to a bottom end portion of the container.

Another object of this invention is to provide an aforementioned base which includes support structure to support and illuminate container placed thereon.

Another object is to provide a base wherein the base includes structure to secure the base to the container such that the base resides under the container and when the container is lifted, the base is lifted with the container.

SUMMARY OF THE INVENTION

This invention is directed to a base for use with and for illuminating a container for liquids, the container having a side wall and a bottom end portion comprised of a bottom wall at least a portion of which is at least partly transparent to light, the base comprising a main body comprised of an upwardly-disposed side wall whose height is substantially less than that of the container side wall, and a bottom wall adapted to carry, or having holder structure for holding, at least one battery preferably two elongated batteries in a substantially horizontal position so that its or their longitudinal axis or axes is or are substantially parallel to a portion of the base bottom wall, a mount for mounting a light bulb in an upward position such that it will direct light toward the bottom wall of the container when it is supported on the base, conductors in communication with the bulb and the at least one battery to complete an electrical circuit therebetween to light the bulb, and support structure to support the container on the base, whereby the base is adapted to illuminate the interior of the container through its bottom wall when the base is provided with said at least one battery and a bulb, when a container is supported by the base and when a circuit is completed between the battery and bulb.

The base can also include securement structure for securing the base to the container such that the base will reside under the container bottom end portion when the container is lifted. The holder structure can comprise a seat which can comprise a recess in the base bottom wall adapted to receive and friction hold the at least one battery or multiple recesses for the batteries. Each recess can have two end walls and a bottom wall, and be slightly longer than the battery to accommodate and hold the electrical conductors tightly in contact between an end wall and a battery end. The holder structure can also comprise one or more retainer members, preferably first, second and third electrically conductive retainer members preferably mounted on the base bottom wall, each retainer member having an upstanding end wall and, the end walls of the first and second retaining members being juxtaposed to the end wall of the third retaining member for communicating with the opposite ends of and friction holding therebetween two elongated batteries in a spread apart relationship. The first retainer member can have an elongated arm extending from the first upstanding end wall and having a mount, desirably at an end portion thereof, and preferably in the form of a loop for holding a bulb therein, preferably at least partly in the space between the batteries and in an upward position. The second retainer member can have an appendage extending from the second upstanding wall, and having structure for contacting the bulb, for example, a tab which extends under the loop for contacting the bottom of a bulb placed in the loop. Each retainer member upstanding end wall can have a lower end or edge. Preferably, it has an arcuately shaped side and bottom edge. Each end wall can have a lower end and a foot plate extending therefrom, and attachment structure for attaching the member to the base bottom wall. The attachment structure can include at least one aperture defined by a rim and extending through each foot plate, and in such case the base bottom wall holder structure can include a plurality of posts extending upward from the base bottom wall, there being a post for and extending through the aperture of and securely attaching each foot plate to the base bottom wall. The posts can be made of thermoplastic material and have heads which overlap and engage the rims. In one embodiment, one or more or each of the retainer member upstanding end walls has a side and/or bottom edge, and the holder structure includes one or more grooves in the base bottom wall, adapted to receive the or the respective retainer member side and/or bottom edge and frictionally hold it in position in its respective groove.

The support structure can be a part of or associated with any portion of the base or main body including its bottom wall. Preferably, the support structure is associated with the base side wall. The support structure can be or include the lip defining the open end or mouth of the base, an inwardly directed ledge or a series of lugs or a bead or beads or convex surfaces. The support structure can also include a panel or disc which can be placed on the lip, ledge, lugs or convex surfaces. The preferred support structure comprises a ledge and/or the inside surface of all or any portion, especially the upper end portion, or its rim of a base side wall which is angularly disposed at an outward angle relative to the vertical. The angle can be less than 30°, desirably less than 20°, preferably, about 10° to about 15° or less.

The securement structure can be or comprise structure integral with, attached to or independent of the base. The securement structure can comprise an outwardly angularly disposed portion of the side wall, which can be the entire side wall, preferably an upper end portion, such as its rim. Integral securement structure can be or include structure radially or otherwise inwardly-directed from the sidewall, such as convex portions, and/or it can include concave portions, a collar, threads for threadedly engaging the bottom end portion of a container, and/or an upwardly extending member which extends from the base side wall and associates with the container to secure or assist in securing the base to the container. The upwardly extending member can be selected from the group consisting of a handle, a handle with a finger, a hook which hooks over a handle on the container, and an upwardly extending member with arms which extend about the container side wall.

Securement structure which is independent of the base can be or include a collar which fits over or is secured to the base and container to secure them together preferably while allowing either or both of them to be manually removed from the collar.

The mount, light source or bulb can be disposed or positioned above the battery or batteries, but preferably the mount is positioned to mount the bulb such that a portion of the bulb is in a plane which passes through a portion of the at least one battery, or through a portion of each battery, and to place the bulb along, i.e. at a point on or along, an imaginary line which extends between and beyond the batteries. Preferably, the mount is positioned between the batteries. The holder structure or conductor can comprise the mount.

The conductor can be an elongated metal member such as a retainer member or a wire, either of which is sufficiently rigid to form a loop to mount the bulb, preferably between the two batteries.

The base can include a reflector for reflecting light to direct it toward the bottom of the container. The reflector can be a conical one having a peripheral lip, a small central aperture and one which is adapted to be mounted on the loop. The base can be adapted such that when it is not secured to the container, the loop has a linking member associated therewith and the loop is at a height such that a bulb mounted in the loop will be elevated from and will not be in contact with the first retainer member tab, but when the base is secured to the container, the container will contact the linking member and move the loop and bulb so that the bulb will contact the tab to complete the circuit and illuminate the bulb and container interior.

The base bottom wall can include a recessed panel portion defined by an upstanding wall, and the holder structure can include one or more grooves, each having a portion which is offset into a portion of the upstanding wall and adapted to receive and frictionally hold one or more of the retainer member end walls therein. The upstanding wall can be comprised of side walls, one alongside one recess and the other alongside the other recess, and of end walls, one at each end of the recesses, and there can be at least one groove in each end wall. The inside surface of each upstanding sidewall can be positioned relative to its adjacent recess to engage and help hold a battery when it is seated in the recess. The base bottom wall can have at least one elevated panel portion between the two recesses. Preferably, the elevated portion has a top surface adapted to support a portion of either or both of the first retainer member arm and/or the second retainer appendage thereon. There can be two axially aligned elevated portions positioned between the recesses, such that there is a space between the elevated portions for positioning a portion of the mount, and the second retainer member tab in said space.

BRIEF DESCRIPTION OF THE DRAWINGS

FIG. 15 is an enlarged vertical section view similar to FIG. 3, showing a modification of the invention.

FIG. 16 is an enlarged vertical sectional view similar to FIG. 3, showing another modification of the invention.

FIG. 17 is an enlarged vertical sectional view with portions broken away, similar to FIG. 13, showing another modification of the invention.

FIGS. 18–23 are enlarged vertical sectional views with portions broken away showing alternative sidewall configurations of the base of this invention.

FIG. 35 is a top plan view of assembled elements of the embodiment of FIG. 34.

FIG. 36 is an enlarged vertical sectional view taken along line 36—36 of FIG. 35.

DETAILED DESCRIPTION OF THE INVENTION

Figure 1:
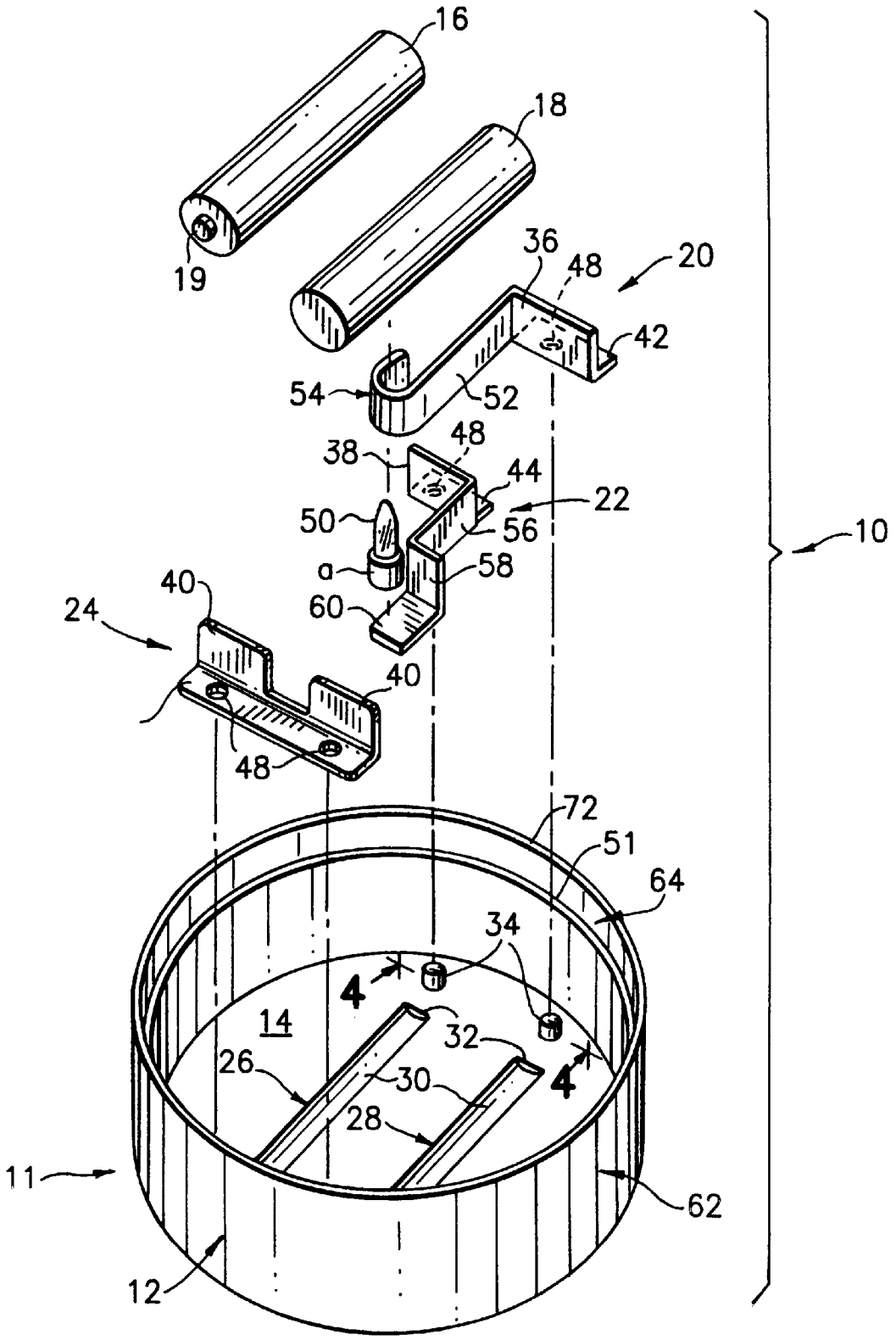
FIG. 1 is and exploded perspective view of elements of a preferred embodiment of the invention.

FIG. 1 shows an exploded view of components of a preferred embodiment of the base device of this invention. More particularly, FIG. 1 shows a base, generally designated 10, for use with and for illuminating a container for liquids (not shown) and comprised of a main body 11 in turn comprised of an upwardly disposed side wall 12, whose height is less than, preferably substantially less than that of the container, and a bottom wall 14, the base, preferably its bottom wall 14, adapted to carry or having holder structure for holding at least one battery, here shown as two elongated batteries 16, 18 having poles 19 (one shown) preferably in a substantially horizontal position so that the battery's or batteries longitudinal axis or axes is or are substantially parallel to a portion of the base bottom wall. A battery's longitudinal axis is considered to run from one end having a pole to the other end. The holder can be any suitable structure. Preferably the holder structure it comprises a seat preferably in the form of retainer members, here shown as first, second and third retainer members generally designated 20, 22 and 24, and it preferably includes at least one recess in the base bottom wall shaped and sized for receiving and friction holding a battery therein. FIG. 1 shows two recesses 26, 28, each spaced from the other and having a bottom wall 30 and end walls 32 (two shown). Preferably the recesses are as deep as possible so that the height of the base side wall can be kept as short as possible. The holder structure also preferably include at least one post 34, two posts 34 being shown, which preferably are but need not be integral with the base bottom wall and positioned adjacent the ends of the recesses. Two additional posts (not shown) are provided adjacent the lower opposite ends of the recesses. Retainer members 20, 22 and 24 are electrically conductive and are adapted to hold the two batteries, preferably elongated ones in a substantially horizontal position between retainer members 20, 22 mounted at one end and retainer member 24 at the opposite end of the batteries. In the preferred embodiment, each retainer member has at least one upstanding end wall and preferably a foot plate for mounting the retainer member to the base bottom wall. As shown in FIG. 1, each retainer member 20, 22, 24 has an upstanding end wall 36, 38, 40 which has a bottom edge portion respectively from which extends a foot plate 42, 44, 46 having suitable structure here one or more apertures 48 defined by one or more rims for securing the retainer member to the base bottom wall. The respective end walls, here 36, 38, of one or more retainer members, here 20, 22, are juxtaposed to the end walls 40 of the other retainer member 24 for communicating with the opposite ends of and friction holding therebetween the two elongated batteries in a spaced apart relationship. Base 10 includes mount structure here comprising a mount secured in any suitable way to a portion of the base for mounting a light bulb, such as 50, preferably in an upward position such that it will direct light or be pointed toward an overlying container bottom wall, (FIGS. 13 and 15) to illuminate the interior of the container when it is supported by the base or when the base is secured to or onto the bottom of the container. Preferably, one of the retainer members 20, 22, 24 includes the mount, and preferably the mount is located between two batteries and/or in a central portion of the base. FIG. 1 shows first retainer member 20 having an elongated arm 52 which extends from upstanding end wall 36 and terminates in a loop 54 adapted to mount and hold light bulb 50 therein. Preferably the light bulb points toward an at least partly transparent portion of the container bottom wall. Second retainer member 22 preferably has an appendage 56 here shown as extending from second retainer end wall 38, the appendage having an extension 58 whose bottom edge portion has a tab 60 extending therefrom to a position under bulb 50. Third retainer member 24 is shown preferably having two upstanding end walls 40 although there could as well be one continuous end wall.

The base includes support structure to support the container thereon. The support structure can comprise any suitable structure, member or members. Although the support structure can be part of or associated with any portion of the base or main body including its bottom wall, preferably the support structure is associated with the base side wall. As shown in FIG. 1, the support structure can comprise ledge 51 associated with side wall 12 and extending radially inwardly therefrom, and or lip 72 at the terminal end of the sidewall. Ledge 51 or lip 72 need not be continuous. For example, a plurality of individual radially inwardly-directed lugs would suffice. The support structure can be or be placed at any suitable height relative to the side wall although it is a main objective of this invention to have the base, sidewall or support short to be substantially shorter than the container, to position the container close to the table or surface on which the base is to rest.

Figure 2:
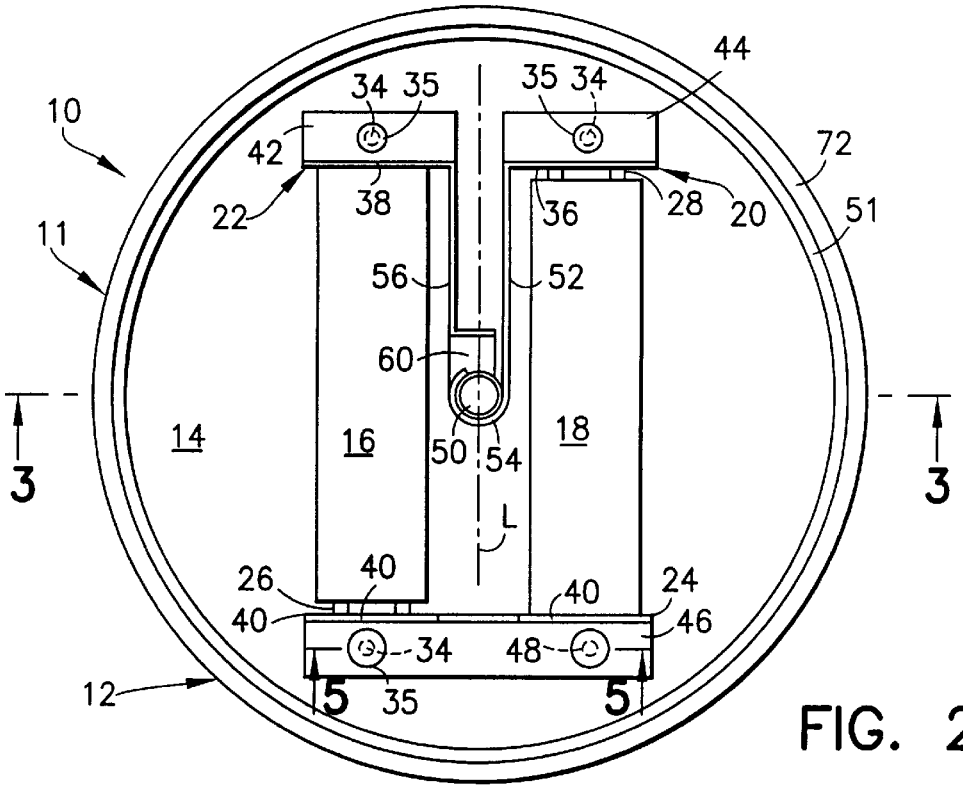
FIG. 2 is a top plan view of assembled elements of the embodiment of FIG. 1.
Figure 3:
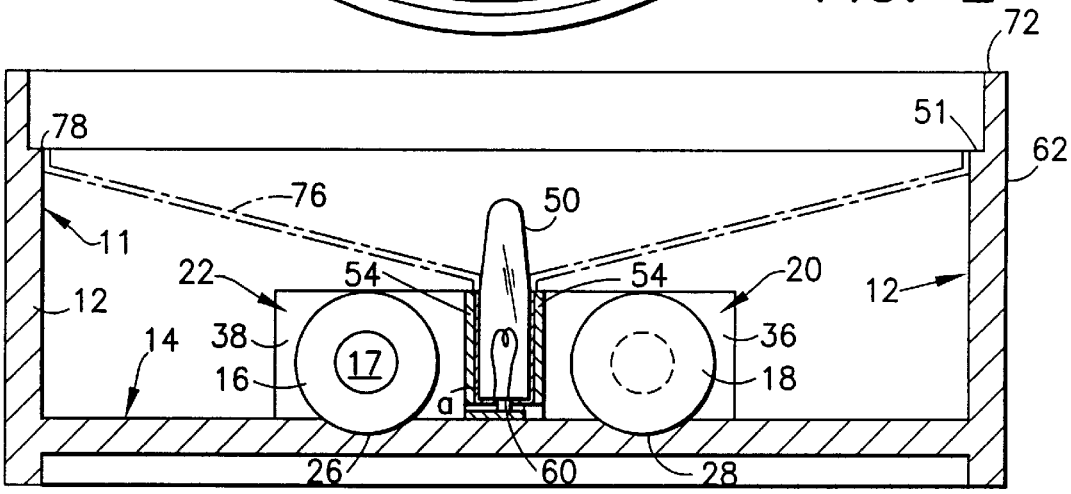
FIG. 3 is an enlarged vertical sectional view taken along line 3—3 of FIG. 2, but also showing in dashed lines an optional light reflector.
Figure 13:
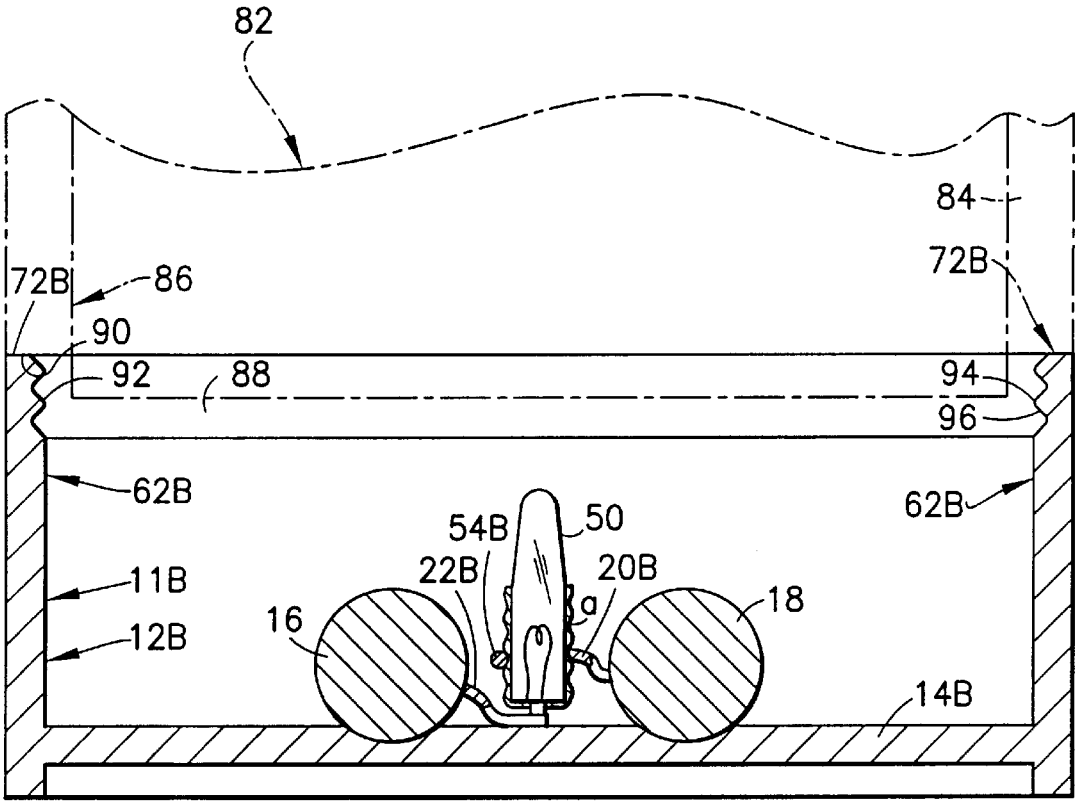
FIG. 13 is an enlarged vertical sectional view taken along line 13—13 of FIG. 12.
Figure 31:
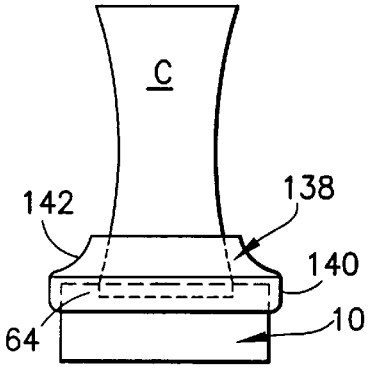
FIGS. 31–33 are side elevational views showing a base of this invention employed with a collar which secures the base and container together.
Figure 32:
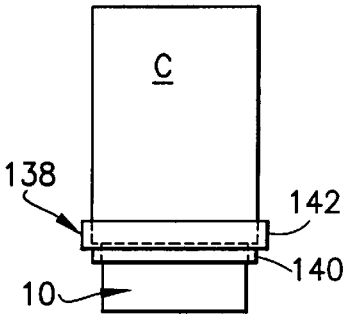
Figure 33:
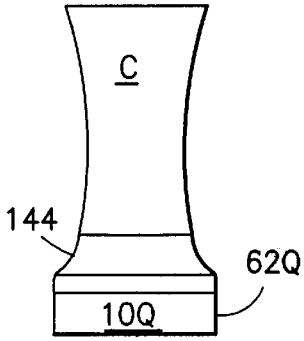

Base 10, preferably its main body 11, also includes securement structure for securing the base or main body to the container, e.g. to or onto the container to reside under the or a portion of the bottom end portion of the container. The securement structure can be any suitable structure associated or cooperative with any portion of the container, for securing or holding the base or its main body in position on and mainly under a container for liquids so that when the container is lifted the base will remain secured to it and will be lifted along with the container such that a light source in the base of the main body can illuminate the interior of the container when a circuit is completed between the battery and bulb. Securing herein can mean permanently securing but usually means removably securing so that the same base which is secured to one container can be removed from that container and can be secured to or onto one or more different containers at different times or independent occasions. Thus, the main body side wall 12 can have an upper end portion, generally designated 62, adapted with structure to secure the base to the container bottom or to a portion of the bottom end portion. For example, as shown in FIGS. 1–3, upper end portion 62 can have a portion, here shown as a substantially vertical, peripheral rim 64 defining a top open end of the base and sized and adapted to receive, fit tightly about and friction hold or secure the base to a portion of the bottom end portion of the container. As shown in FIG. 13, the rim inside surface can have threads 66 on its inside or outside surface to threadedly secure an also threaded container bottom end portion here, representatively generally designated 68 in FIG. 13. Rim 64 may be adapted or may be provided with structure or a surface or finish such as a roughened or abrasive texture, or a partial adherent to increase the friction hold of the rim on the container. The rim need not be substantially vertical. As shown in FIGS. 18–23 the rim may be disposed at an angle and in any case may be adapted to have or may have structure, for example convex beads and or concave cutout surfaces to secure the base to the container. The securement structure can be associated with virtually any portion of the base and/or container. For example, as will be explained in connection with FIGS. 24–29, securement structure can comprise an extension from the base which communicates with or engages a portion of the container, for example a portion of the side wall or rim or handle of a container if it has one. Also as shown in FIGS. 31–33, the securement structure can be or include independent structure such as a collar for securing the base to the container or vice versa.

FIG. 2 is a top plan view of base 11 of FIG. 1 with its elements assembled. More particularly, FIG. 2 shows base main body 11 whose side wall has an upper edge or lip 72 defining the opening at the upper end of the base, and ledge 51 extending radially-inwardly therefrom. Retainer members 20, 22, 24 are mounted and secured or attached to base bottom wall 14 by any suitable attachment structure, here shown as posts 34 extending through apertures in respective foot plates 42, 44, 46, the upper surfaces of the posts being formed into heads, generally designated 35, which overlappingly engage and secure the foot plates to the bottom wall radially outwardly of the apertures. Batteries 16, 18 are seated in recesses 26, 28 and their ends are frictionally retained and held by the retainer members. First retainer member upstanding end wall 36 and the (rightward) juxtaposed upstanding end wall 40 of third retainer member 24 frictionally hold battery 18 in recess 28, and second retainer member upstanding end wall 38 and juxtaposed (left) third retainer upstanding end wall 40 frictionally hold battery 16 in recess 26. FIG. 2 shows arm 52 extending diametrically to the base between batteries 16, 18 from first retainer member end wall 22 and terminating in loop 54 which extends substantially around and mounts and holds bulb 50 in an upstanding position therein. Bulb 50 thereby is mounted in a central location of base 10. Appendage 56 of second retainer member upstanding end wall 38 likewise extends diametrically to the base between batteries 16, 18 and communicates with and terminates with tab 60 having a portion which extends under bulb 50. FIG. 2 shows the base assembled such that an electrical circuit is completed between the bulb and batteries through electrically conductive retainer members 20, 22, 24 to illuminate the bulb of base 10.

FIG. 3, a vertical section taken along line 3—3 of FIG. 2, shows bulb 50 having a metal jacket "a" securely mounted within loop 54 and the pole at the bottom of the bulb in contact with tab 60 of second retainer member 22. FIG. 3 shows a suitable height of side wall 12, wherein ledge 51 which is to support a container bottom (not shown) is in a plane with ample clearance above the bulb, although the sidewall could be shorter or the ledge could be positioned lower on the side wall just above the bulb to reduce the height of the base in accordance with an objective of this invention. FIG. 3 also shows that base 10 optionally can include reflective material, here shown as a reflector (dashed lines) generally designated 76 for reflecting light from bulb 50, up into the interior of the container (not shown). The reflector can be of any suitable size, shape, material or configuration, but preferably it is conical as shown, having a small central aperture defined by a cylindrical wall which here fits over and around bulb 50 and whose lower edge sits on loop 54. The reflector can be placed on or associated with any suitable structure. For example, it could sit on the bulb or on its jacket or on one or more of the retaining members. One or more reflective surfaces can be provided on the interior of the base and can be used instead of or with a reflector. In FIG. 3 the upper terminal edge 78 of the reflector is below or at the plane of ledge 51. A mounted reflector can comprise support structure for supporting the container in lieu of or in cooperation with ledge 51 or other support structure.

Figure 4:
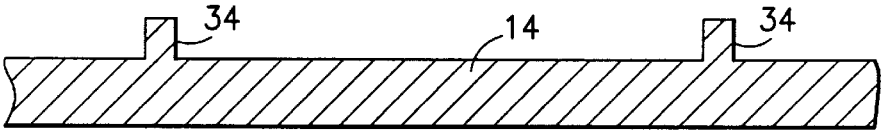
FIG. 4 is an enlarged vertical section with portions broken away taken along line 4—4 of FIG. 1.

FIG. 4 shows posts 34 integral with and extending upwardly from base bottom wall 14.

Figure 5:
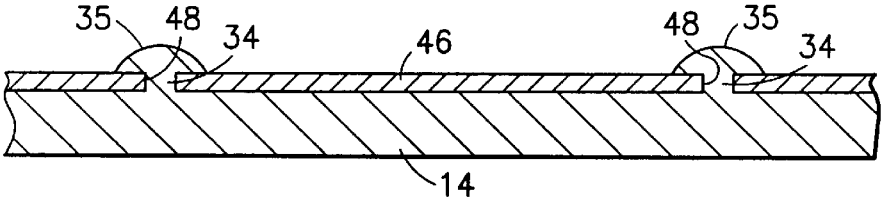
FIG. 5 is an enlarged vertical section with portions broken away taken along line 5—5 of FIG. 2.

FIG. 5 shows posts 34 extending upwardly through apertures 48 of third retainer member footplate 46 and the upper portions of the posts flattened, peened, melted or otherwise modified such to form heads which overlap underlying portions of the footplate and secure it to base bottom wall 14.

Figure 6:
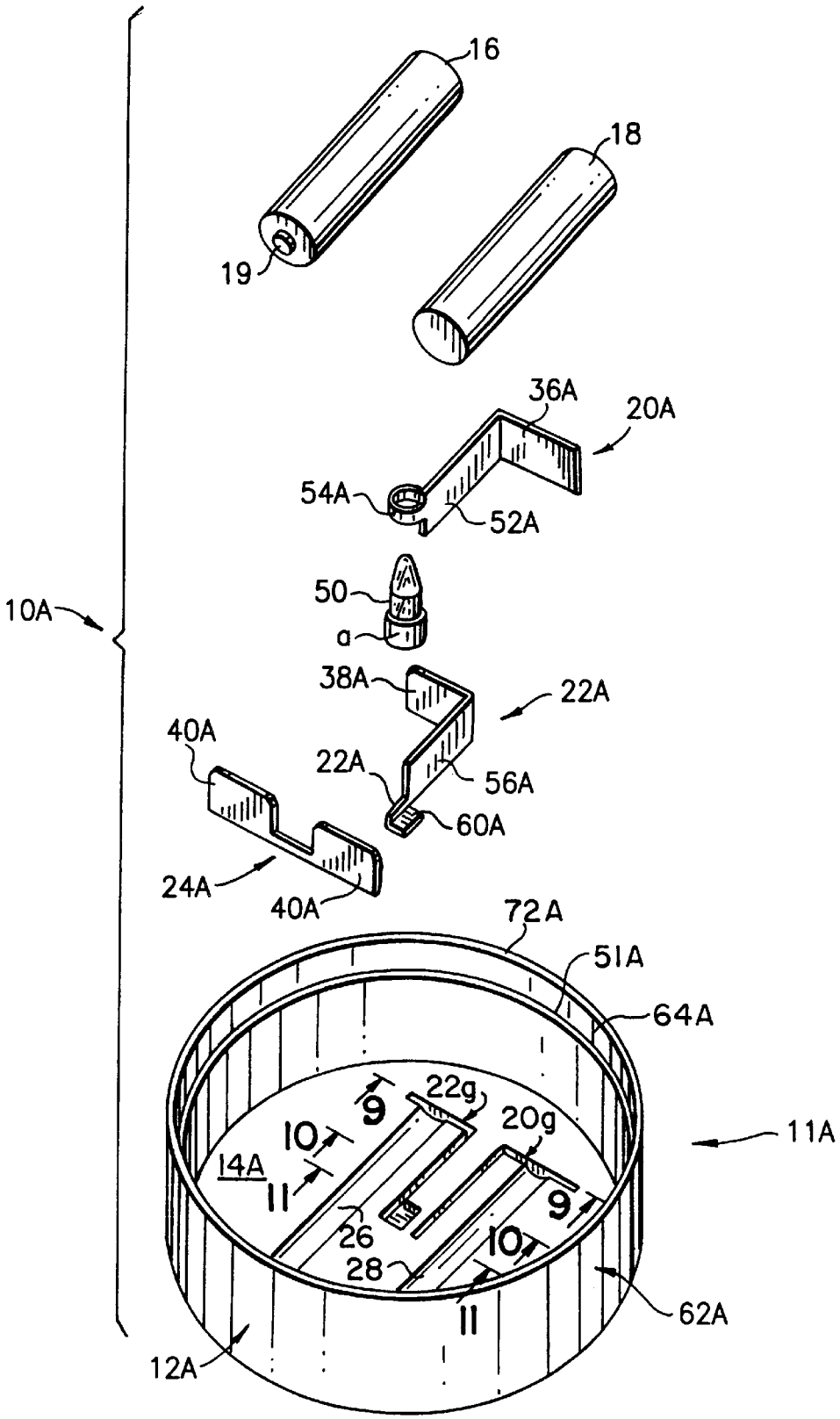
FIG. 6 is an exploded perspective view of elements of an alternative embodiment of the invention.

FIG. 6, an exploded view of components of an alternative embodiment of the base of the invention, is similar in many respects to the components of base 11 of FIG. 1, except as to portions of the first and second retainer members, holder structure for holding the retainer members, and the upper end portion of the main body side wall. More particularly, FIG. 6 shows a base 10A having a first retainer member 20A whose arm 52A has and here terminates in a loop 54A which extends substantially 360° about bulb 50. Loop 54A is narrower than arm 52A and loop 54 of FIG. 1. Appendage 56A of second retainer member 22A terminates in a short leg 22A which has a tab 60A extending substantially horizontally and vertically from the leg. None of the retainer members 20A, 22A, 24A have a footplate. In this embodiment, holder structure for holding the batteries includes an arrangement of grooves formed in base bottom wall 14A to receive and frictionally hold the retainer members therein. More particularly, FIG. 6 shows groove 20*g* shaped as a substantially inverted L and shaped and dimensioned to correspond to the shape of and to receive and frictionally hold therein a bottom edge portion of end plate 36A and of arm 52A of first retainer member 20A. Groove 22*g* is likewise shaped and dimensioned to correspond with a bottom edge portion of end plate 38A, appendage 56A and the bottom of tab 60A. Though hidden by sidewall 12A and not shown, there is a straight groove 24*g* (FIG. 7) at the lower end of recesses 26, 28 to receive and frictionally hold a bottom edge portion of retainer member 24A. Retainer members, if employed as holder structure, need not be used relative to ends of the batteries. For example, retainer members with two side plates instead of end plates could be used relative to receiving and friction holding a portion of the length of the sidewall of each or a battery. A centrally located side plate could have a short arm or tb with fingers or a hole or groove adapted to mount a bulb therein.

FIG. 6 represents embodiments and shows an embodiment wherein a base 11A does not have or utilize securement structure for securing the base to a container. Rather, FIG. 6 shows a base 11A adapted to have a light source and to be used mainly as a support, for example like a coaster, for a container, wherein sidewall upper end portion 62A, and/or rim 64A, and/or lip 72A and/or ledge is or are dimensioned or adapted to be or comprise support structure to support a container, or container bottom, bottom wall or bottom end portion thereon. Thus, for example, lip 72A could be of smaller circumference than the container bottom, or rim 64A or a portion of or the entire side wall could be angled and merely support a portion of or the container bottom, or ledge 51A could engage a portion of the container bottom and thereby support the container. Alternatively, the lip can extend outwardly as a flange, and the lip or ledge can extend radially inward as a flange or flanges to accommodate and support variety of containers having bottoms of a different sizes. The support structure can comprise a portion or component of the base, such as a one or more pillars integral with or attached thereto and extending upward from the base bottom wall (not shown), or it can comprise the top edge of a conductor or retainer member end wall, arm or appendage. The support structure can comprise one or more independent or separate elements, for example, a disc or panel, or couplers, e.g. hangers or clips having a support surface and integral with, hung from, inserted in, attached, connected, e.g. pivotally, or otherwise associated with a portion of the base, preferably its sidewall. When the support structure comprises a disc or panel, it can be of any suitable size, thickness, pattern, shape or material such that it is supportable by base support structure, it can support a container thereon and it allows light to pass therethrough including through an aperture thereof to illuminate the interior of a supported container. Thus, the panel or disc can be supported by lip 72 or 72A, ledge 51 or 51A or other structure associated with the base, base bottom wall or sidewall.

Figure 7:
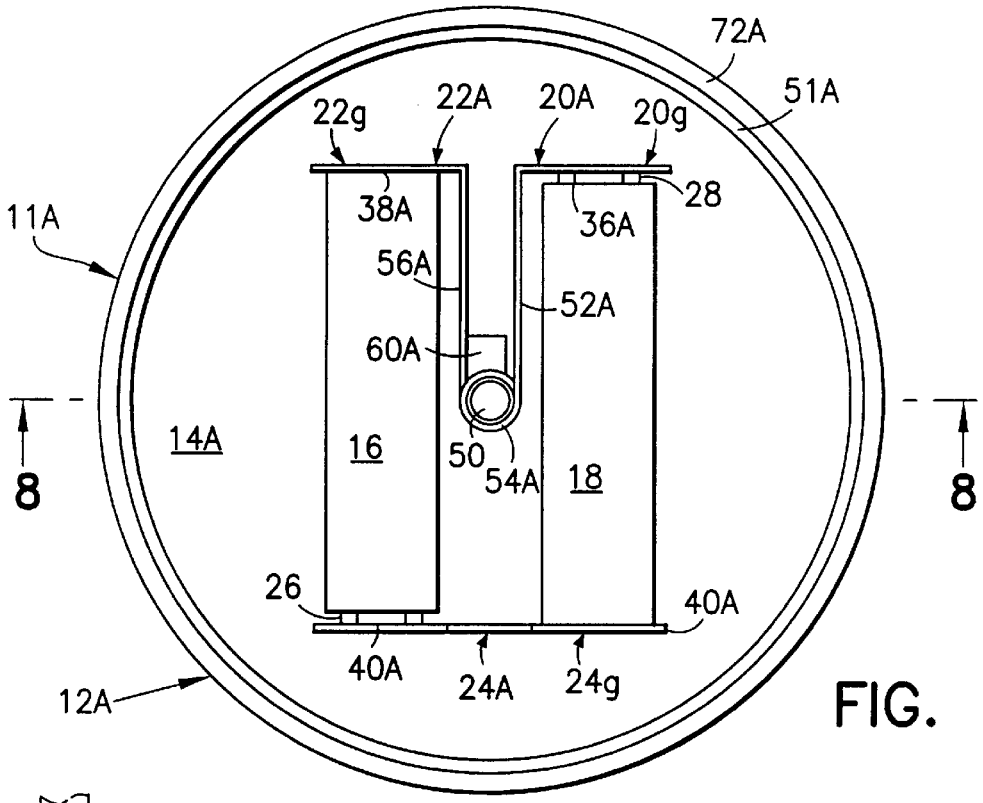
FIG. 7 is a top plan view of assembled elements of the embodiment shown in FIG. 6.

FIG. 7 is a top plan view of base 10A of FIG. 6 with its elements assembled. More particularly, retainer members 20A, 22A and 24A are mounted and secured to base bottom wall 14A by the respective members' end wall bottom edge portions being frictionally seated in and held within respective correspondingly shaped grooves 20*g*, 22*g* and 24*g*. Battery 18 seated in recess 28 has its ends frictionally retained and held by and between, first retainer member end wall 36A and the juxtaposed (rightward) upstanding end wall 40A third retainer member 24A. Battery 16 seated in recess 26 has its ends frictionally retained and held by and between second retainer member end wall 38A and the juxtaposed (leftward) end wall 40A of third retainer member 24A. Loop 54A at the end of arm 54A of retainer member 20A extends fully or substantially fully about bulb 50 and thereby mounts the bulb therein, between the batteries and centrally of the base. Tab 60A at the end portion of appendage 56A of retainer member 38A extends under bulb 50. When the bulb's bottom pole contacts tab 60A, an electrical circuit is completed between the bulb and batteries through conductors, here retainer members 20A, 22A, 24A to illuminate bulb 50.

Figure 8:
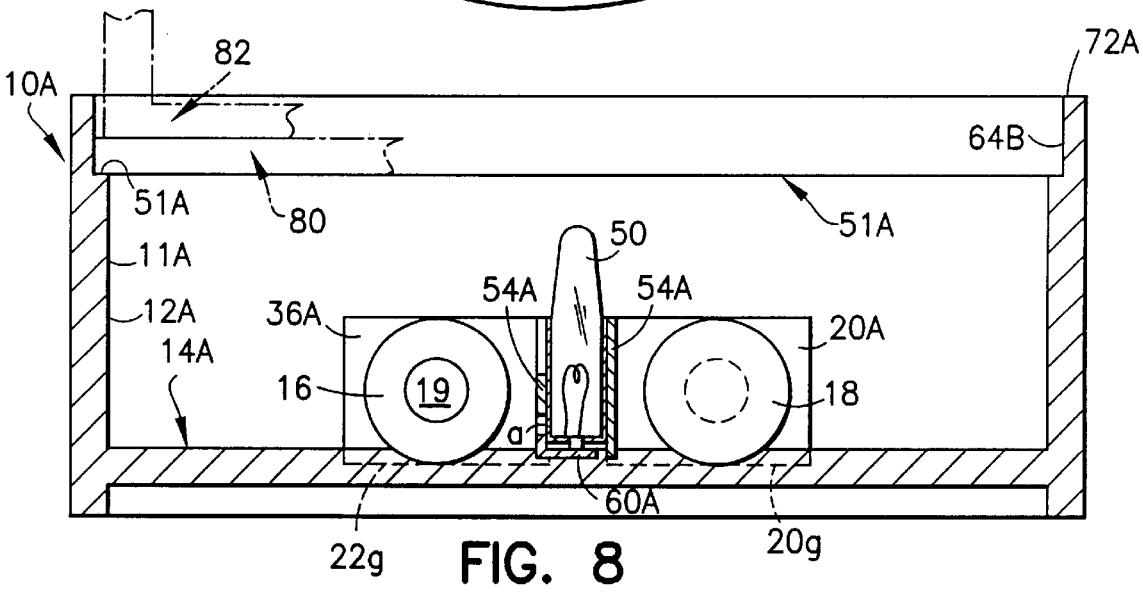
FIG. 8 is a vertical section taken along line 8—8 of FIG. 7.

FIG. 8, a vertical section taken along line 8—8 of FIG. 7, shows bulb 50 mounted within loop 54A and the pole of the bulb in contact with tab 60A to illuminate the bulb. FIG. 8 shows grooves 20*g* and 22*g* (dashed lines) holding the bottom edge portions of retainer members 20A and 22A therein. As previously stated, base 10A either does not have or does not employ securement structure, and a container can be supported directly or indirectly on lip 72A, and/or on ledge 51.

FIG. 8 also shows that base 10A can comprise or be employed with support structure comprising a disc or panel, here generally designated as 80 (shown in phantom lines to the upper left side of FIG. 8) which rests on ledge 51A. The panel is shown supporting a container (phantom lines) generally designated 82 thereon. Only a portion of panel 80 is shown. Instead of panel 80 being supported on ledge 51, panel 80 can rest on side wall lip 72 and thereby support a container thereon. Of course, two panels can be employed, one supported on ledge 51A and the other on lip 72A, the higher one preferably supporting the container. Alternatively, the panel can have one or more individual flange members (not shown) depending from the underside thereof to reside to either or both sides of base sidewall rim 64B to locate or maintain the panel on lip 72. The panel may have a central opening therein. It is desirable to employ base 10A as a coaster with a panel because the panel, preferably transparent can bear printing, logos, slogans, pictures, designs, patterns, textures or any desired message or advertisement to achieve any desired effect both with and without illumination and both with or without an empty or filled container thereon. One or more panels can be permanently, removably or pivotally attached to base 10 or 10A. A permanently and not pivotally or translatably attached panel which for example can be a full panel extending across and covering the entire open area defined by lip 72 or 72A or ledge 51, 51A may require another portion of the base, e.g. the bottom wall or a portion of the side wall to be removable, to provide access to the interior of the base e.g. to the lighting system or light source. The bottom wall or the side wall thus need not be integral with the base as either or both can be adapted to be removable with or without the lighting system and components for replacement of the bottom wall, or the component(s) associated therewith.

Figure 9:
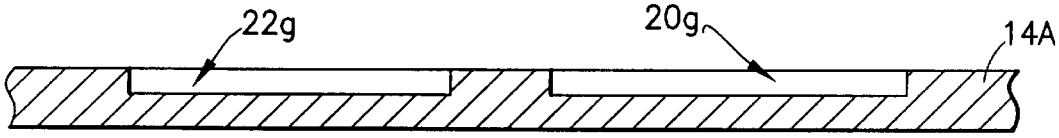
FIG. 9 is an enlarged vertical section with portions broken away taken along line 9—9 or FIG. 6.

FIG. 9, a cross section taken along line 9—9 of FIG. 6, shows respective grooves 20*g* and 22*g* in base bottom wall 14A for receiving a or the bottom edge portion of third retainer member 24A and frictionally holding its upstanding end walls 40A.

Figure 10:
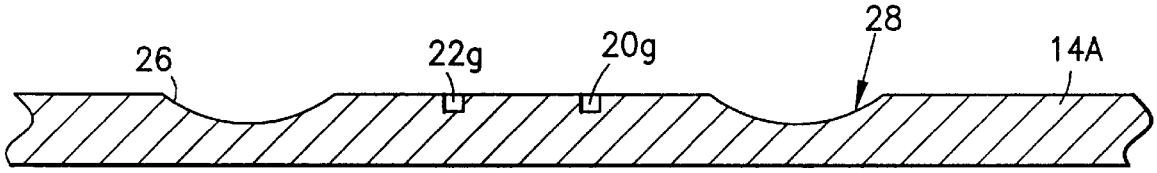
FIG. 10 is an enlarged vertical section with portions broken away taken along line 10—10 of FIG. 6.

FIG. 10, a cross section taken along line 10—10 of FIG. 6, shows a portion of respective grooves 20*g*, 22*g* in bottom wall 14A between recesses 26, 28, for receiving and frictionally holding in the grooves the respective arm 52A of retainer member 20A and appendage 56A of retainer member 22A.

Figure 11:
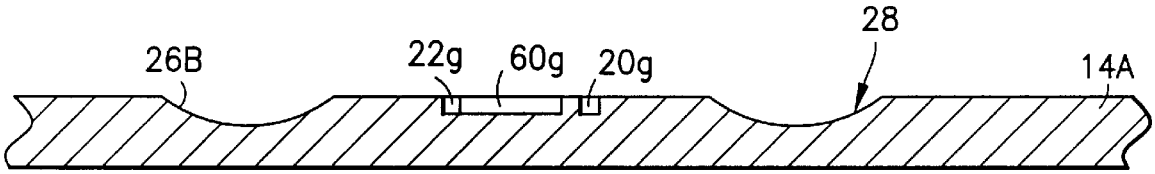
FIG. 11 is an enlarged vertical section with portions broken away taken along line 11—11 of FIG. 6.

FIG. 11, a cross section taken along line 11—11 of FIG. 6 through portions of grooves 22*g* and 60*g* for receiving and frictionally holding second retainer member arm 56A and tab 60A extending therefrom.

Figure 12:
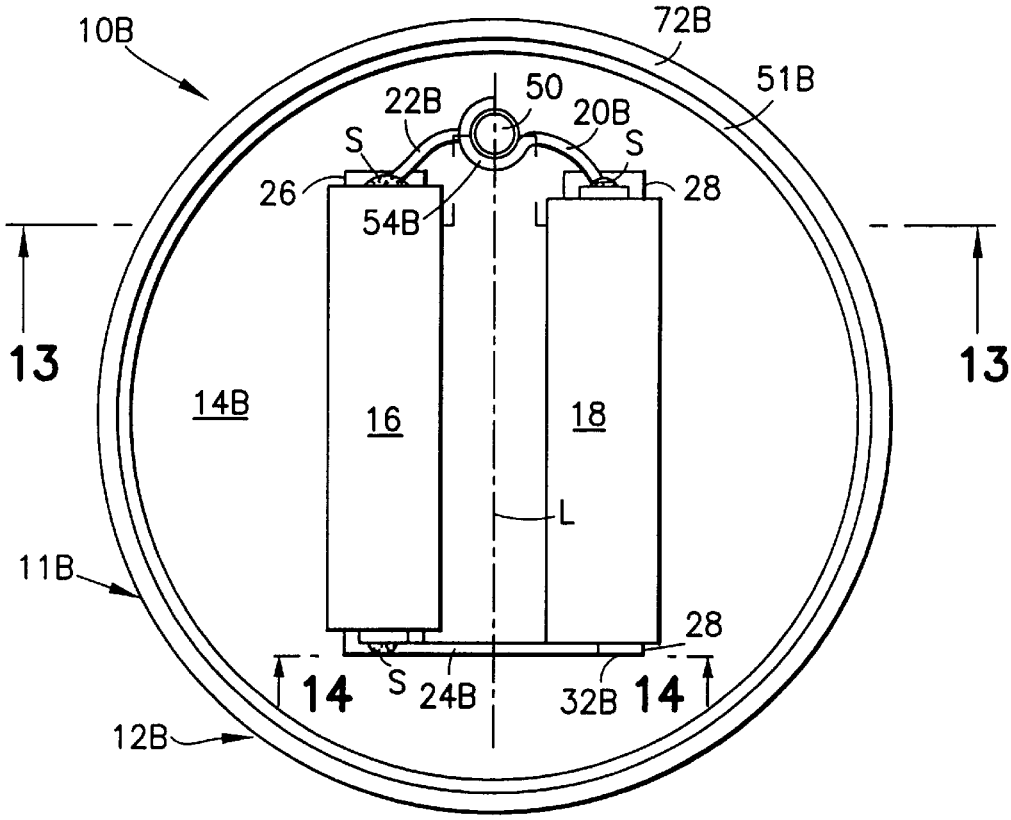
FIG. 12 is a top plan view of an alternative embodiment of the invention.

FIG. 12, a top plan view of another embodiment of the base of this invention, shows a base, generally designated 10B for use with and for illuminating a container for liquids. The base comprises a main body 11B comprised of a bottom wall 14B and an upwardly-disposed side wall 12B, having a radially inwardly-extending ledge 51B and terminating in a lip 72B, which defines an opening at the upper end of the base. Conductors, here shown as bendable but sufficiently rigid elongated members, here shown as, wires 20B, 22B and 24B communicate with and complete an electrical circuit between batteries 16, 18 and bulb 50 to illuminate the bulb. Base 10A has holder structure, here shown as recesses 26, 28 each formed in bottom wall 14B and shaped, dimensioned and designed to receive and frictionally hold batteries 16 and 18 therein. One end of wire 20B is connected to the pole of battery 18 by solder S, and the other end of wire 20B forms a mount, here by being in the form of a loop 54B which extends sufficiently but not fully around bulb 50 such that bulb 50 can be and is mounted therein in an upward position to be pointed toward a container bottom supported on or secured to the base, to direct light upward and illuminate the interior of the container. Wire 20B preferably is bendable yet sufficiently rigid to form a loop which securely mounts and holds bulb 50 therein. Wires 22B, 24B, are also bendable to be formed or shaped to extend to and on or over the surface of bottom wall 14B and to extend into and desirably take the shape of a portion of the recess, for example the concave shape of its bottom wall. One end of wire 22B is associated with, here shown by being soldered by solder S to, one end of battery 16, and the other end of the wire extends under the pole of bulb 50 for contacting the same. The height of wire 54B above bottom wall 14B and the seating or mounting of bulb 50 therein are adjusted to place the wire and bulb pole in contact permanently, or, as will be explained in connection with other embodiments, to space the bulb pole from wire 12 B so that for example upon movement of the bulb or wire downward, contact between the wire and bulb pole will be obtained. One end of wire 24B is shown soldered by solder S to the pole of battery 16 and the other end of the wire is manually removably in contact with the adjacent end of battery 18. As shown in FIG. 12, the length of respective recesses 26, 28 is adapted to tightly accommodate and frictionally hold the end of wire 24B in place in contact with the end of battery 18. Likewise, at the opposite ends of the batteries, the recess end walls are adapted to contact and frictionally hold the wires 20B, 22B and/or the solder S and thereby frictionally hold the respective batteries and wires in the recesses.

FIG. 13, an enlarged vertical sectional view taken along line 13—13 of FIG. 12, shows loop 54B of wire 20B mounting and holding bulb 50 at a height such that its pole is in contact with the underlying end of wire 22B which in turn rests on bottom wall 14B. FIG. 13 shows in phantom lines above base 14B, a container for liquids generally designated 82 with portions broken way, having a side-wall 84, a bottom end portion generally designated 86 and a bottom wall 88 at least a portion of which is partially transparent to light. Container bottom end portion 86, adjacent the junction the sidewall and bottom wall, has a radially inwardly directed substantially horizontal wall 90 which communicates with lowermost cylindrical portion 92 having peripheral threads 94 thereabout. Base 10B has securement structure, here shown as radially inwardly directed threads 96 on the interior surface of a portion of base wall upper end portion 62B, for securing, meaning removably securing, the base to the container. In this embodiment, the support structure includes base side wall lip 72B which supports container 82 at container wall 90, and the threaded portion 96 of the base side wall upper end portion 62B which threadedly engages and also supports container 82. The height of base side wall 12B is substantially less than the height of the container side wall or container. Although not shown in FIGS. 3, 8, 10, 11 and 13, the bottom surface of the bottom wall can have an outwardly convex bulbous shape corresponding to and directly under each recess, such being desirable for forming, e.g. thermoforming the recesses, especially deep ones.

Figure 14:
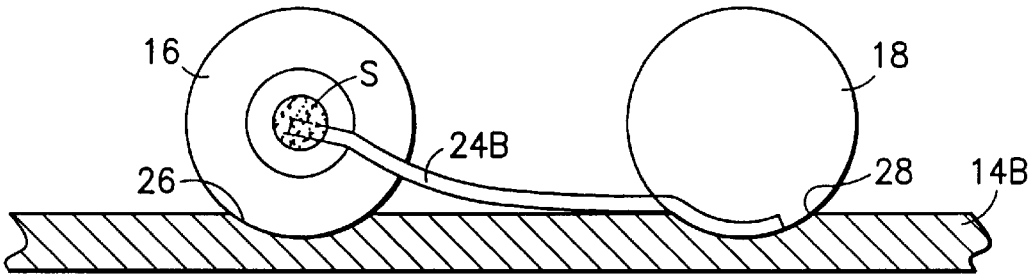
FIG. 14 is an enlarged vertical section with portions broken away taken along line 14—14 of FIG. 12

FIG. 14, an enlarged vertical section taken along line 14—14 of FIG. 12, shows batteries 16, 18 in elevation seated in recesses 26, 28 and one end of wire 24B soldered by solder S to the pole at the end of battery 16 and the wire bent to pass over and run along base bottom wall 14B, and run down into recess 28. Recess 28 is deep and long enough to accommodate the wire such that end wall 32B (FIG. 12) frictionally holds an end portion of the wire between it and, in contact with, the adjacent end of battery 18.

FIG. 15 is an enlarged vertical section similar to that taken along line 3—3 of FIG. 2, but through an alternative embodiment of the base of the invention. More particularly, FIG. 15 shows an embodiment of the base, generally designated, 10C, wherein loop 54C and elongated bulb 50*c* mounted therein are positioned such that the pole at the bottom of the bulb is elevated or spaced above retainer member tab 60C. In the embodiment, a portion of first retainer member 20C, preferably of its arm (not shown) with loop 54C is flexible, resiliently bendable or movable such that downward pressure on the arm, bulb 50C or loop 54C will move the bulb's pole into contact with tab 60C thereby completing a circuit to light the bulb. Although FIG. 15 shows the conductor, tab 60C, resting on bottom wall 14C, the conductor or tab 60C can be rigid and elevated any suitable distance above the top surface of bottom wall 14C. Although there are many ways included in this invention to switch the bulb on and off, FIG. 15 shows a preferred one wherein the base or main body 11C and/or appropriate elements are adapted such that seating of the container 82C upon the base will light the bulb. FIG. 15 demonstrates the concept of the use of a linking member employed to communicate with the container and a component of the base or light source to activate the circuit and light the bulb when a container is lowered onto or placed on the base. In FIG. 15 the linking member is the elongated bulb. More particularly, FIG. 15, shows in phantom lines a container 82C, with portions broken away, whose bottom end portion 88C has a depending cylindrical portion having a bottom wall 89C and a peripheral outer wall 98. The container is shown not quite fully seated upon base ledge 51. As and when the container is seated on ledge 51, bottom wall 89C engages the top of elongated bulb 50 and moves the bulb downward, bringing its pole into contact with tab 60 to illuminate the bulb.

FIG. 16 shows an alternative embodiment of the base of the invention like that shown in FIG. 15, but wherein instead of the bulb being elongated such that it extends above the plane of ledge 51 and is contacted by the container bottom wall, the bulb is of normal height and a reflector such as 76 is mounted about bulb 55 on loop 54C in a manner such that all or a portion of reflector upper terminal edge 78 is located above the plane of sidewall ledge 51. FIG. 16 shows reflector 76 as the linking member and container bottom wall 89C in contact with reflector edge 78. As the container is lowered further and seated on reflector ledge 51, container bottom wall 89C forces the reflector, loop 54C and bulb 50 downward bringing the bulb's pole into contact with underlying second retainer member tab 60C resting on bottom wall 14C. A panel such as designated 80 in FIG. 8 may be employed on reflector 72.

FIG. 17 is a vertical section as would be taken through an alternative embodiment of the base shown in FIG. 13. FIG.

17 shows that the components of base 14B shown in FIG. 13 can be employed as in the manner shown in FIG. 15 wherein an elongated bulb 50B, similar to 50C, and a flexible portion of retainer member wire 20B enable the components shown in FIG. 17 to act as a switch to bring the bulb into contact with wire 22B when a container is seated on a base as described in relation to FIG. 13.

FIGS. 18–22 are vertical sections with portions broken away showing the base 10 of this invention having alternative configurations of side wall 12. FIG. 18 shows a base main body side wall upper end portion 62D having a rim 64D positioned at an angle to frictionally engage and secure the base to a bottom end portion of a container for liquids (not shown). Preferably, the rim is adapted to not only secure the base to a container whose bottom is pushed into the rim area of the base, but also to be support structure to support the container. If rim 64D is not sufficient to support the container, or it is desired to provide additional support, the top surface of a ledge 51D projecting radially-inwardly from the interior of side wall 12D can be employed to support the container in cooperation with rim 64D. Also, if the base is used with a container having a bottom narrower than the rim, ledge 51D can support such a container. FIG. 18 represents a plastic base made by a thermoforming process such that each ledge 51D has a corresponding substantially juxtaposed indentation or inward offset "i" into the exterior surface of the side wall 12D. Rim 64 need not be but preferably can bend or its material can compress a little or flex outwardly to receive or while receiving and securing therewith the bottom of a container. The angularity and/or movement of the rim can allow the rim to accommodate bottoms of glasses whose diameters vary somewhat, for example, in some instances say from 3/16 to 1/4 inch.

FIG. 19 shows a base main body side wall upper end portion 62E having a relatively elongated angularly disposed rim 64D which is adapted to secure and support a container (not shown) whose bottom end portion is brought into engagement with the interior surface of the rim.

FIG. 20 shows a base main body side wall upper end portion 62F whose rim 64F is substantially vertically disposed and whose inner surface is shaped or profiled and dimensioned to receive and fit snugly about a bottom end portion of a container. Here, the rim inner surface preferably has a continuous convex bead 100 extending radially-inwardly from adjacent lip 72. Bead 100 communicates with a concave surface here shown as an undercut generally designated 102, which in turn communicates with a second radially-inwardly extending continuous convex bead 104. When the bottom end portion of a container, for example one having bulbous shape such as what is called a pilsner beer glass, is moved into the base mouth defined by lip 100, the lip will give outwardly and slip over the bulbous base of the glass and its bulbous base will be received within in undercut 102. The glass will be secured by bead 100 and undercut 102 and will be supported by bead 104.

FIG. 21 shows a base main body side wall upper end portion 62G whose rim 64G is radially-outwardly angled and whose inner surface has a continuous convex bead 106 extending radially-inward from a portion of the rim between lip 72 and the junction of rim 64G and the more vertically disposed underlying portion of side wall 12G. As in FIG. 20, bead 106 communicates with an undercut 108 and a second bead 110 to secure and/or support a container thereon.

FIG. 22 shows a securement structure in the form of a substantially vertically disposed side wall rim 64A whose inner surface has an inwardly projecting bead 112 adjacent lip 72. Rim 64H is shown without support structure, but lugs or other optional suitable support structure generally designated 114 (dashed lines) which are part of, or secured to, or used in cooperation with rim 64H or side wall 12H can be employed to support a container thereon.

FIG. 23 shows another substantially vertically disposed rim 64I having an inward projection or bead 116 spaced from lip 72 for securing a container.

The entire side wall of, or the upper end portions or rims of the side walls of the bases of this invention, including those shown in FIGS. 18–23, can be disposed at any suitable angle outward from the vertical, given the selected thickness of the rim., the nature, strength and/or flexibility and/or resiliency of the material of which the upper end portion or rim is made, and the size of the container bottom end portion to be secured and/or supported. Individuals in the art will know to coordinate these factors to provide the desired securement and/or support structure for a given container. A suitable angle for the base side wall or portion of it, such as its upper end portion, e.g. its rim, can be less than 30°, preferably less than 20°, most preferably about 10° to about 15° radially or otherwise outwardly from the vertical. The sidewall can be a combination of angles. For example, it can be about 10° to about 15° proceeding upwardly from the junction with the bottom wall, and its upper end portion or rim can be at a lesser angle, for example, nearly vertical.

It is understood that any base of this invention can be adapted to be used as a coaster or support structure for a container having bottom end portion which is of a dimension which will be supported by the base or by a support structure such as a ledge, lug or panel employed thereon or therewith. For example, a container or a panel to support a container can be supported on any lip 72, and a panel can be supported on or across a plane of the inner surface of an angled rim, or on any ledge, bead protrusion or lug which can serve as a support surface.

Figure 24:
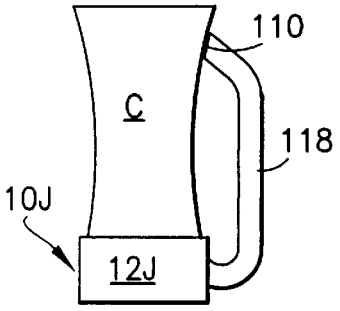
FIGS. 24–30 are side elevational views of alternative embodiments of the base of this invention.

FIGS. 24–30 shows examples of alternative embodiments of the base of this invention having structure, for example upwardly-extending members such as handles, to secure or assist in securing the base and container together. More particularly, FIG. 24 shows a base 10J supporting a container C and whose side wall 12J communicates with an upwardly-extending handle 118 whose upper end need not but is here shown as terminating in a terminal end wall 110 which need not but preferably abuts the side wall of a container here shown as a Pilsner type glass generally designated C. Lifting the handle of the bases shown on these embodiments will lift the base with the container supported thereon and/or secured thereto.

Figure 25:
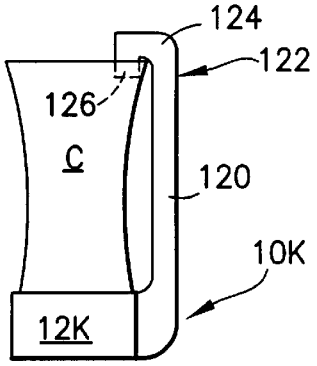

FIG. 25 shows a base 10K whose handle 120 has a marginal end portion 122 which terminates in a finger 124 extending from the marginal end portion over the lip of container C to help secure the container with or in or to the base. Finger 124 optionally may have a downwardly depending portion 126 which extends into the container to further secure the container to the base.

Figure 26:
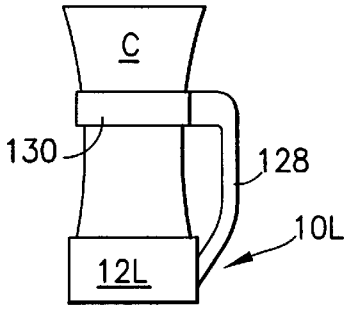

FIG. 26 shows a base 10L whose handle 128 communicates with one or more members, here a pair of arms 130 (one shown) which extend about and loosely or tightly stabilize or secure container C with the base. Arms 130 need not extend substantially completely about the container and they can communicate with or extend from any desired vertical location of the handle.

Figure 27:
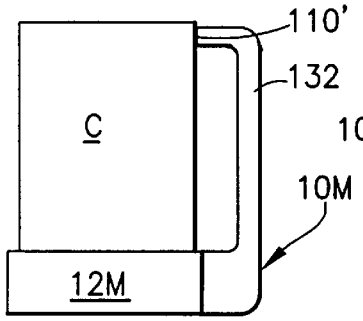

FIG. 27 shows a base 10M having a handle 132 whose terminal end 110' abuts a container having a substantially vertical side wall portion.

Figure 28:
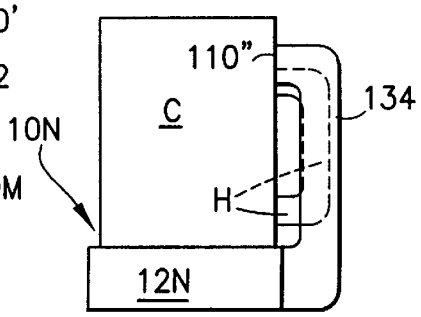

FIG. 28 shows a base 10N whose handle 134 is adapted to secure or help secure base 10N to a container. More particularly, handle 34 has a hollowed substantially inverted U-shaped portion which fits over the handle H of a container C such as a mug. As shown, the handle can have its terminal end 110' abut the container side wall.

Figure 29:
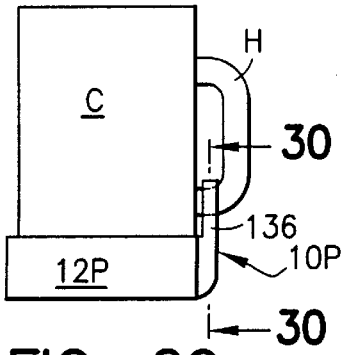
Figure 30:
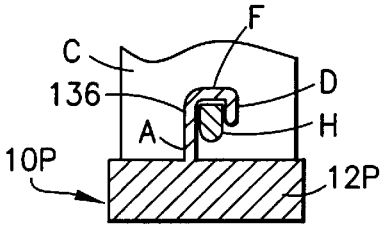

FIGS. 29 and 30 show a base 10P whose side wall 12P has an upwardly-directed extension, here shown as a hook 136 adapted to engage the handle H of a container C. Hook 136 includes upward arm A, a substantially horizontal finger F and, optionally, a depending digit D. Hook 136 secures or helps secure the base to the container.

FIGS. 31–33 show bases of this invention secured to a container C by securement structure comprised of a collar which can be independent of or secured or integral with the base. FIGS. 31 and 32 show a collar 138 as an independent member whose lower portion 140 fits tightly over and onto a portion of the base, desirably a portion of the upper end portion such as rim 64. The collar can be adhered or otherwise attached or secured to the base. The collar extends upwardly from the base and upper portion 142 of the collar is resiliently biased radially inwardly or otherwise fits tightly over a bottom end portion of container C. Collar 138 is strong enough to secure or help secure the base to the container yet has resiliency or flexibility sufficient to give radially outwardly and allow the container and/or base to be manually received by and removed from the collar. A collar can be the sole or an additional or complimentary securement structure for a base of this invention.

FIG. 32 shows collar 138 employed to secure a base to a container where the base diameter is less than that of the container which it supports and to which it is secured. Collar 138 allows securement and use of bases and container of different shapes and sizes and is particularly useful to secure to a container a coaster-type base which may not have its own securement structure.

FIG. 33 shows a base 10Q having a collar 144 attached to or integral with a portion of the base, here its upper end portion 62Q. Preferably, collar 144 is adhered to end portion 62Q by a suitable adhesive (not shown). Alternatively, collar 144 can be ultrasonically spin welded to a base. The collar can be made of any suitable material(s). As will be explained, the collar can be made of a rubber(ized) elastic (ized) or foamed or elastomeric material, which can desirably provide a tight-fit with the container and/or base.

Figure 34:
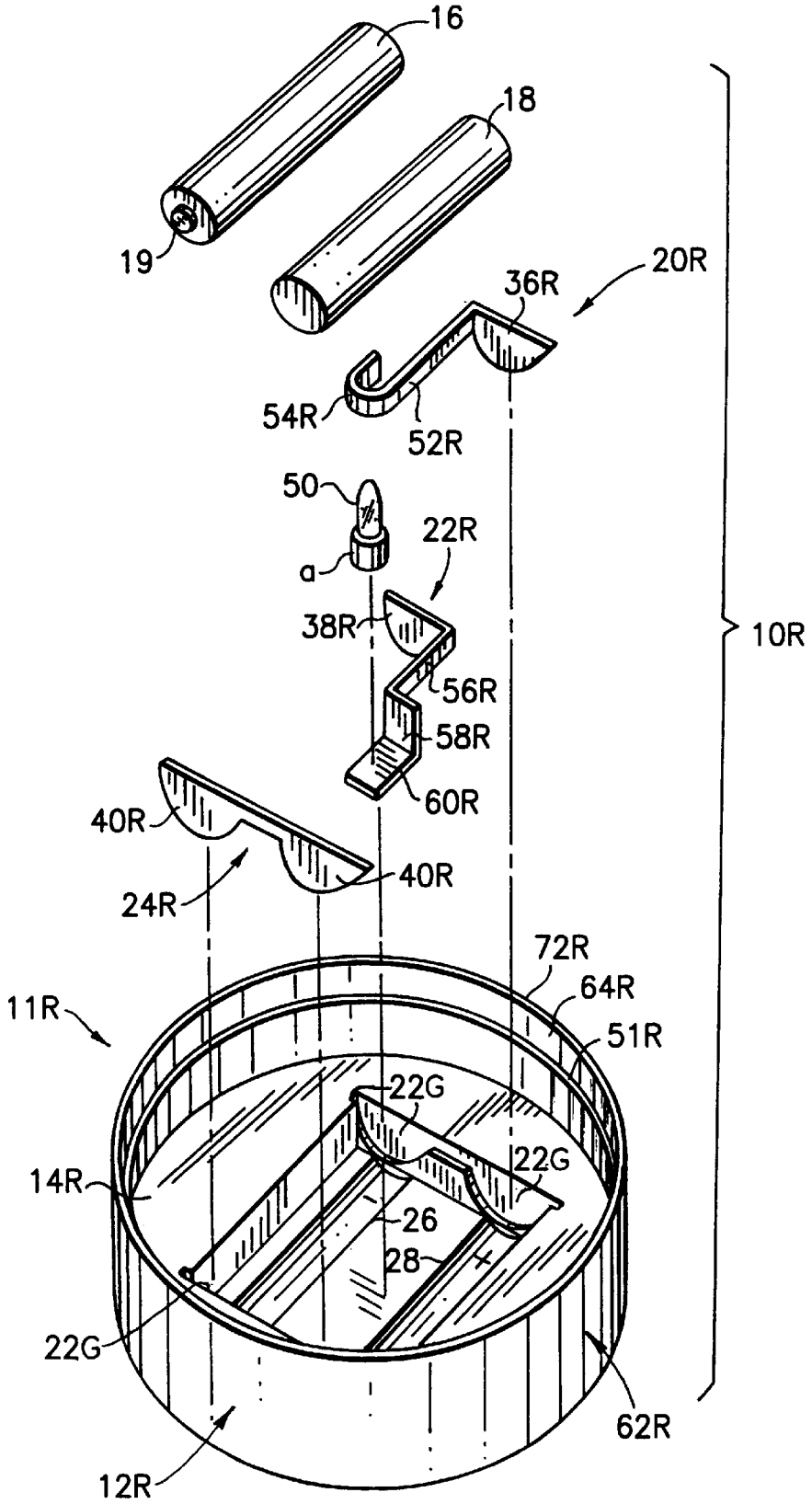
FIG. 34 is an exploded perspective view of elements of an alternative embodiment of the invention.

FIG. 34, an exploded view of components of an alternative embodiment of the base of the invention, is similar in many respects to the components of base 11 of FIG. 1 and base 11A of FIG. 6, except for example as to portions of the first and second retainer members, and holder structure for holding the retainer members. More particularly, FIG. 34 shows a base 10R having a first retainer member 20R whose arm 52R terminates in a loop 54R to hold bulb 50 therein. Appendage 56R of second retainer member 22R terminates in a tab 60R extending substantially horizontally and vertically from the leg. In this embodiment, holder structure for holding the batteries includes grooves formed in a portion of base bottom wall 14R to receive and frictionally hold the retainer members therein. More particularly, FIG. 34 shows groove 22G which is carved, formed, or offset into here a depending or upstanding wall portion of bottom wall 14R and which in this embodiment is shaped as if to hold a pair of eyeglasses. Groove 22G, including its slight terminal end cutouts into the bottom wall, is shaped and dimensioned to correspond to the shape of and to receive and frictionally hold and retain therein a preferably arcuately or half-moon shaped side and bottom edge portion of end wall 36R of first retainer member 20R, and of end wall 38R, of second retainer member 22R. Though partly hidden by sidewall 12C, there is a similarly shaped groove 22G at the other, here lower end of recesses 26, 28 to receive and frictionally hold and retain a bottom and side edge portion of retainer member 24R, preferably shaped like a pair of eyeglasses. Each groove 22G, one at either end of the battery recesses 26, 28, is shaped so that it can receive and hold first and second retainer members 20R or 22R, or third retainer member 24R at either end of the recesses. As shown, the bottom portions of groove 22G are not but they can be slotted at their outer extents to receive and frictionally engage the edge or marginal edge portions of the retainer member end walls therein.

FIG. 34 is like FIG. 6 in that it represents embodiments and shows an embodiment wherein a base 11R is adapted to have a light source and to be used mainly as a support, for example like a coaster, for a container. What is disclosed herein with respect to FIG. 6 applies to FIG. 34 wherein elements of the base comprise support structure to support a container, or container bottom, bottom wall or bottom end portion thereon.

FIG. 35 is a top plan view of base 10R of FIG. 34 with its elements assembled. More particularly, retainer members 20R, 22R and 24R are mounted and secured to base bottom wall 14R by the respective members' end wall bottom and side edge portions being frictionally seated in and held within respective correspondingly shaped grooves 22G. The retainer members can be adhered by a suitable adherent to the groove wall in addition to or instead of being held by grooves 22G. Battery 18 seated in recess 28 has its ends frictionally retained and held by and between first retainer member end wall 36R and the juxtaposed (rightward) upstanding end wall 40R of third retainer member 24R. Battery 16 seated in recess 26 has its ends frictionally retained and held by and between second retainer member end wall 38R and the juxtaposed (leftward) end wall 40R or of third retainer member 24R. Loop 54R at the end of arm 54R of retainer member 20R extends fully or substantially fully about bulb 50 and thereby mounts the bulb therein, between the batteries and centrally of the base. Tab 60R at the end portion of appendage 56R of retainer member 38R extends under bulb 50. When the bulb's bottom pole contacts tab 60R, an electrical circuit is completed between the bulb and batteries through conductors, here retainer members 20R, 22R, 24R to illuminate bulb 50.

FIG. 36, a vertical section taken along line 36—36 of FIG. 35, shows bulb 50 mounted within loop 54R and the pole of the bulb in contact with tab 60R to illuminate the bulb. FIG. 36 shows groove 22G (part in solid line and part in dashed lines) holding the bottom and side edge portions of retainer members 20R and 22R thereon and therein. Base 11R either does not have or does not employ securement structure, and a container can be supported directly or indirectly on lip 72R, and/or on ledge 51R. Bottom wall 14C in FIG. 36 has peripheral portion which is elevated and a recessed central panel portion RP defined by and having an upstanding wall 15 and a horizontal wall 15R to more securely seat batteries 16, 18 in bottom wall 14R. The inside surface of upstanding wall 15 preferably touches or engages the battery that is near it and helps to hold the batteries in recesses 16, 18. Grooves 22G are offset into a portion of the upstanding wall. Preferably, the upstanding wall is comprised of side walls, one alongside one recess and the other alongside the other recess, and end walls, one at each end of the recesses. Preferably, there is at least one groove in each end wall.

Figure 37:
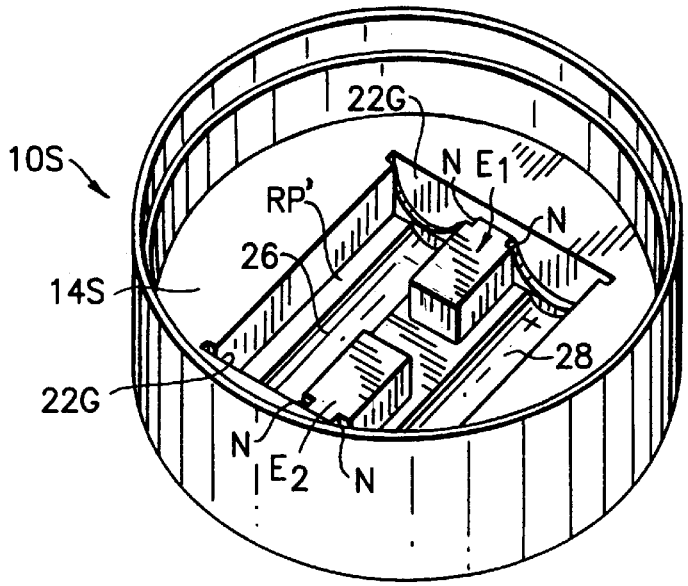
FIG. 37 is a perspective view of another embodiment of the base of the invention.

FIG. 37 shows another embodiment of the base of the invention. FIG. 37 shows the base 10S whose bottom wall recessed panel portion RP' has elevated portions E1 and E2 which preferably are axially aligned and whose side walls preferably cooperate with recessed horizontal walls 15S to hold batteries, not shown, in place in recesses 26, 28. The elevated portions E1 and E2 have notches N therein which are part of grooves 22G for holding retainer members (not shown) therein. Portions E1 and E2 have a top surface preferably adapted to support a portion of either or both of the first retainer arm and/or second retainer appendage thereon. Between the elevated portions, a space is provided for positioning a portion of the bulb mount 54R and second retainer tab 60R therein.

Figure 38:
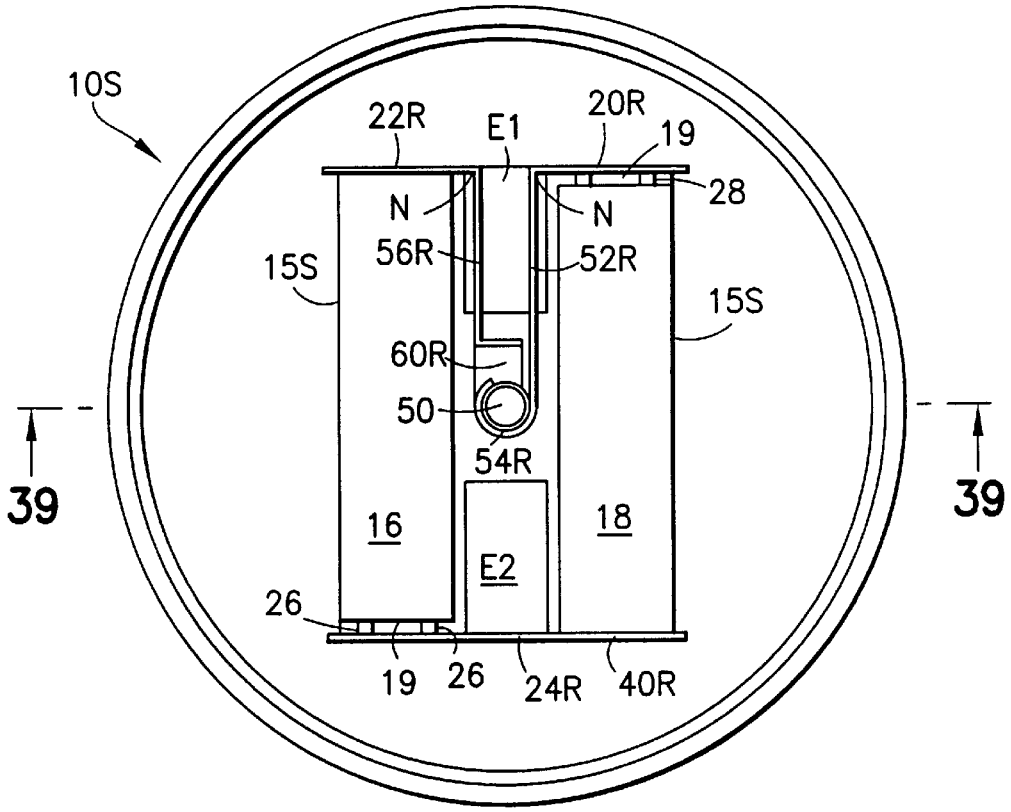
FIG. 38 is a top plan view of the embodiment shown in FIG. 37 with elements assembled to a base embodiment of the invention.
Figure 39:
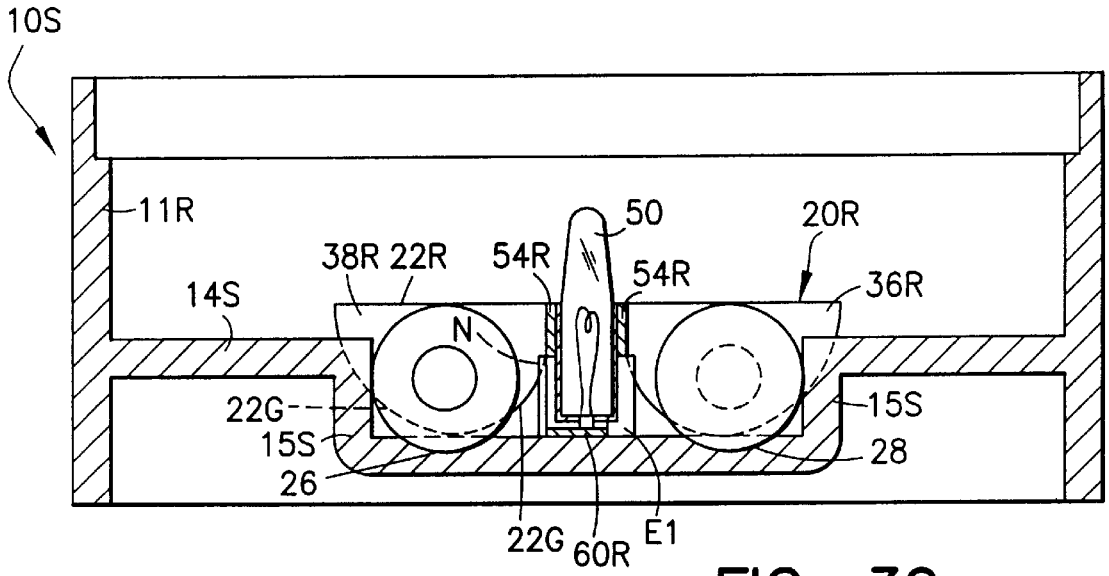
FIG. 39 is an enlarged vertical sectional view taken along line 39—39 of FIG. 38.

FIG. 38 shows the base 10S with parts assembled wherein arm 52R of first retainer member 20R and appendage 56R of second retainer member 22R are above and, as shown in FIG. 39, preferably rest on and supported by bottom wall elevated portion E1.

FIG. 39, a cross-section taken along line 39—39 of FIG. 38, shows batteries 16, 18 seated in recesses 26, 28 and held in place by bottom wall recessed panel upstanding walls 15S and retainer members 20R and 22R, and first retainer arm 52R and second retainer appendage 56R above and preferably resting on the top surface of elevated panel portion E1. FIG. 39 shows loop 54R holding bulb 50 between batteries 16, 18. This configuration stabilizes the mounting means while mounting the bulb between the batteries and economizing space to permit base 10S to have a short sidewall and allow a container to sit low in the base preferably without touching the bulb. Loop 54 could be flared to provide a reflector to direct light upward through the or a portion of the bottom container bottom wall. Elevated portions E1 and E2 can be widened such that their side walls engage and help hold the batteries in place. Those side walls and/or walls 15S can be concavely shaped to accommodate or match the shape of the batteries if desired.

Figure 40:
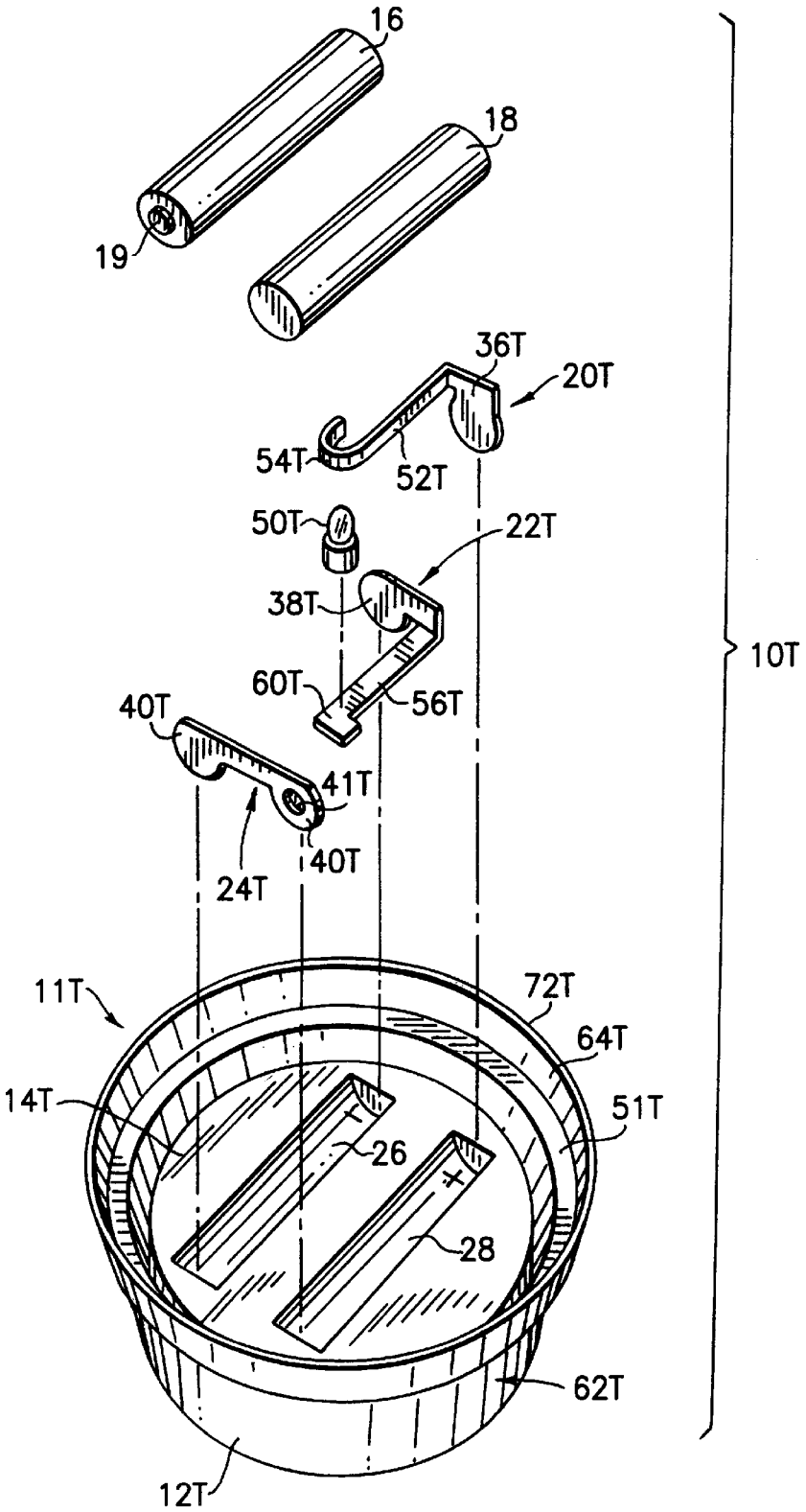
FIG. 40 is an exploded perspective view of elements of an alternative embodiment of the invention.

FIG. 40 shows that in another embodiment of the base of the invention, a base 10T can have the retainer members shown, wherein first, second and third retainer members 20T, 22T and 24T have respective end walls 36T, 38T, and 40T, each having an arcuate side and lower edge portions adapted to friction fit into and be held by the arcuate shape of recesses 26, 28 at the junction of the recesses' respective bottom walls and end walls. Again, an adherent can be employed to removably or permanently adhere the retainer member end walls to the end walls of the recesses. In this embodiment, the extension 56T of second retainer member 22T is horizontally disposed and is in the same plane as tab 60T. Also, the right-hand arcuate portion of end wall 40T has an offset protruding portion 41T which protrudes beyond the plane of end wall 40T to engage the negative end of battery 18.

Figure 41:
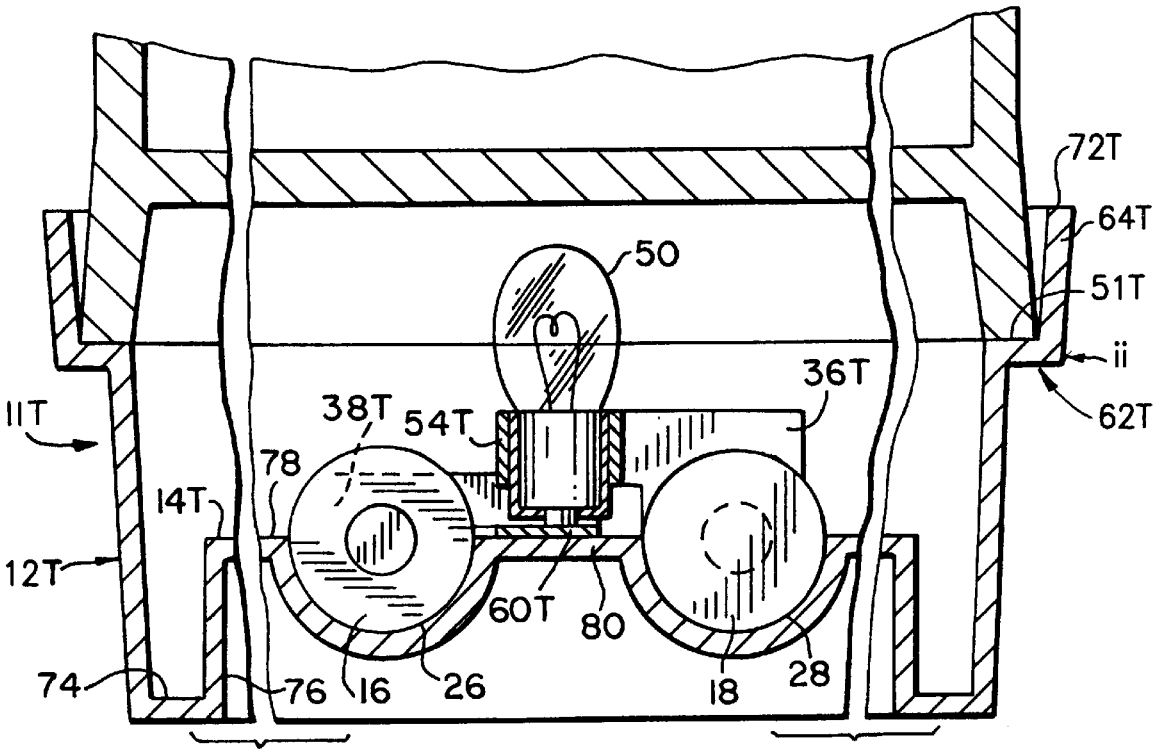
FIG. 41 is an enlarged vertical sectional view similar to FIG. 39 as would be taken diametrically through the embodiment shown in FIG. 40 in a manner similar to the sectional view shown in FIG. 39, after the elements shown in FIG. 40 are assembled.

As shown in FIGS. 40 and 41, base main body 11T is comprised of a side wall 12T which can be of any suitable shape, but preferably is substantially vertical or, as shown, slightly conically shaped (having a smaller diameter towards the bottom wall). Side wall 12T has an upper end portion 62T which is preferably offset at ii and has a radially outwardly extending ledge 51T which communicates with rim 64T. Rim 64T preferably is conically shaped or disposed at a slight outward angle such that its lip 72T has a diameter which for example is about 0.070 inch greater than the diameter of rim 64T where it joins ledge 51T. FIG. 41 shows that base main body bottom wall 14T has a peripheral portion 74 which extends inwardly from the bottom edge of side wall 12T, communicates with an upwardly extending counter sink wall 76, which in turn communicates with a raised central panel portion 78 having an interior portion 80 between recesses 26, 28. FIG. 41 shows recesses 26, 28 formed deep into the bottom wall such that their upper edges preferably are approximately diametrical to the batteries. The recesses can be slightly deeper and shaped to snap-in receive and frictionally hold the batteries therein. The bottom wall configuration shown in FIGS. 40 and 41 is preferred and particularly adapted for main bodies of the base of this invention which most preferably are formed by a thermoforming process. The embodiment disclosed in FIGS. 40 and 41 represents the most preferred embodiment of the invention.

The base of this invention can be separate from or integral with a container, as when it is part of a molded or formed plastic container. Regardless, the base can have a portion which is translatable, pivotable or removable therefrom to allow access to and/or removal, return or replacement of an interior component, e.g. of the light source, e.g. batteries, bulb and/or conductors, which reside(s) in the base. For example, the bottom wall or side wall or portion(s) thereof, can be removable, etc., with the light source, to provide access to the same. Providing such access removal and return capabilities allows the light source to be removed from the base to allow the base or the container to be washed, or to repair or replace one or more components of the light source. The light source can be held on a carrier such as a disc, panel or slab which can act as the or a second base bottom wall or portion thereof and/or which can rest on the bottom wall proper. The base can be of any suitable size, shape or dimension. Bases which are to be secured to containers most desirably have a peripheral shape corresponding to or consistent with that of the container to which it is to be secured. However, if the base is to serve as a coaster or support it can have a different shape. It can be square, rectangular, oblong or of any other suitable shape.

The holder structure for holding the battery and or batteries can be any suitable structure. Such structure are well known in the art, for example in toys, flashlights and other battery-operated devices and lighting systems. The same applies to the mount for mounting the bulb, and to the conductors. For example, though not shown in the drawings, there can be employed metal springs and metal spring clips at ends of recesses for holding the batteries, these also serving as conductors. Though three retainer members are shown in the drawings, it is understood that less or more may be employed. Conductors of any suitable type can be employed and held if necessary to, or embedded or molded into the carrying material or structure. For example, wires can be inserted in grooves molded or formed in the base bottom wall and they can run to a bulb which can be mounted by any suitable structure, for example, it can be mounted in a socket, and/or a hole formed in a base bottom wall or panel. Such grooves and/or hole can easily be formed in a base wall made of a plastic, e.g. a styrenic or polystyrene polymer material, such as a styrofoam. Although the bulb can be located in any suitable position in the base, including on or above a horizontally disposed battery, as shown in the Figures, preferably the bulb and/or mount for the bulb is positioned such that a portion of the bulb is in a plane which passes through a portion of the at least one battery and if more than one battery is employed, preferably through a portion of each battery. Although the bulb can be positioned, e.g. to the side of or beyond the batteries or near the side wall, preferably it is located centrally in the base, and preferably between the batteries, e.g. at some point on or along an imaginary line ("L" in FIGS. 2 and 12) shown extending between the batteries.

The light source can be any suitable component associated in suitable arrangement or system for producing or emitting light, i.e., and it can include a case or include or be a flashlight. An example of a suitable source of light is disclosed in U.S. Pat. No. 4,032,773. The light bulb can be activated or energized by any suitable means, and the light emitted can be steady, flashing or moving or provide other special colors, patterns or effects. The energy to provide the light can be provided by any suitable source for the bulb or light emitter employed. Although one or more 9-volt batteries could be employed in certain instances, one or more preferably two AA single batteries are used. The light source can be associated with a switch structure, arrangement or system to activate the light bulb when the base or container is lifted, placed on the base, or when the base is lifted or placed on a surface.

The base of this invention can be made of any suitable material or combination of materials which can be formed, molded or injected into the form of a base. Preferably, the base is made of a structural polymeric material, such as a polyolefin, especially polypropylenes, polyethylenes and combinations and copolymers of the same. A preferred material is polyvinyl chloride. Polyethylene terephthalates, polycarbonates, isotatic polypropylenes, polyamides, and styrenic materials such as polystyrenes can be employed. Materials suitable for forming a collar can include or be elastomeric materials such as ethylene butadiene rubbers, ethylene propylene-diene rubbers, polybutadiene, butadiene-styrene rubbers, polyisoprene and polyisobutylene, ethylene-vinyl acetate copolymers and ionomers. The preferred materials for forming the base are polyvinyl chlorides and polypropylenes, formed or molded preferably with heat. Styrenic materials, e.g. styrofoams may also be suitable for some applications. The preferred process is a thermoforming process, wherein for example, a heated sheet of the material is pushed by a male die into a mold or female die in the form of the base. Other plastic forming, e.g. molding processes such as injection molding or injection or extrusion blow molding can also be employed.

Various modifications and variations of the base or container and base of this invention may be made within the spirit of the invention and scope of the following claims.

What is claimed is:

1. A base for use with and for illuminating a container for liquids, the container having a side wall and a bottom end portion comprised of a bottom wall at least a portion of which is at least partly transparent to light, the base comprising a main body comprised of an upwardly-disposed side wall whose height is substantially less than that of the container side wall, and a bottom wall having at least one recess therein and adapted to receive and friction hold at least one battery in a substantially horizontal position in said recess so that the longitudinal axis of said at least one battery is substantially parallel to a portion of the base bottom wall, a mount for mounting a light bulb in an upward position such that it will direct light toward the bottom wall of the container when it is supported on the base, conductors in communication with the bulb and at least one battery to complete an electrical circuit therebetween to light the bulb, and support structure to support the container thereon, whereby the base is adapted to illuminate the interior of the container through its bottom wall when the base is provided with said at least one battery and a bulb, when a container is supported by the base and when a circuit is completed between the battery and bulb.

2. The base of claim 1 wherein the side wall is integral with the bottom wall, and the side wall upper end portion is disposed at an angle of from about 5° to about 20° outwardly from the vertical, and comprises the support structure.

3. The base of claim 1, wherein the side wall upper end portion is disposed at an angle of from about 5° to about 20°.

4. The base of claim 2 or 3 wherein the angle is about 10° to about 15°.

5. The base of claim 1 or 2 wherein the mount is disposed above the at least one battery.

6. The base of claim 1 wherein the base includes holder structure for holding at least one battery in said substantially horizontal position in the at least one recess.

7. The base of claim 4 wherein the base includes holder structure for holding the at least one battery in said substantially horizontal position in the at least one recess.

8. The base of claim 5 wherein the base includes holder structure for holding the at least one battery in said substantially horizontal position.

9. The base of claim 6 wherein the holder structure comprises the mount.

10. The base of claim 7 wherein the holder structure comprises the mount.

11. The base of claim 1 or 6 wherein there is included non-threaded securement structure for securing the base to the container such that the base will reside under the container bottom end portion when the container is lifted.

12. The base of claim 2 wherein there is included non-threaded securement structure for securing the base to the container such that the base will reside under the container bottom end portion when the container is lifted and the securement structure comprises the angularly-disposed side wall upper end portion.

13. The base of claim 12 wherein the base includes holder structure for holding the at least one battery in substantially horizontal position in the at least one recess and the holder structure comprises the mount.

14. The base of claim 12 wherein the mount is disposed above the at least one battery.

15. The base of claim 6 wherein there are two elongated batteries, and the holder structure includes a recess in the bottom wall adapted to receive and friction hold each battery.

16. A base for use with and for illuminating a container for liquids, the container having a side wall and a bottom end portion comprised of a bottom wall at least a portion of which is at least partly transparent to light, the base comprising a main body comprised of an upwardly-disposed side wall whose height is substantially less than that of the container side wall, and a bottom wall, holder structure for holding at least one battery in a substantially horizontal position so that its longitudinal axis is substantially parallel to a portion of the base bottom wall, the holder structure including at least one recess in the bottom wall for friction holding the at least one battery therein, a mount for mounting a light bulb in an upward position such that it will direct light toward the bottom wall of the container when it is supported on the base, conductors in communication with the bulb and at least one battery to complete an electrical circuit therebetween to light the bulb, and support structure to support the container thereon, whereby the base is adapted to illuminate the interior of the container through its bottom wall when the base is provided with said at least one battery and a bulb, when a container is supported by the base and when a circuit is completed between the battery and bulb.

17. The base of claim 16 wherein the recess includes at least one seat for holding a battery therein, and a conductor comprises the mount, said conductor being an elongated metal member in communication with the battery and sufficiently rigid and adapted to mount the bulb.

18. The base of claim 17 wherein said conductor includes a wire connected to one end of the battery and having a portion removed from the connection which is formed into a loop to mount the bulb therein.

19. The base of claim 18 wherein the holder structure comprises two elongated recesses formed in the base bottom wall, each recess being for friction holding a battery therein, an elongated battery is held in each recess, a conductor communicates with one set of ends of the batteries, the wire mount is rigidly connected to one battery end of the other set of ends of the batteries, a bulb is mounted in the loop and another conductor communicates with the other battery end of the other set of ends of the batteries.

20. The base of claim 19 wherein each recess has two end walls and a bottom wall, and each recess is slightly longer than the battery to accommodate and hold the electrical conductors tightly in contact between an end wall and a battery end.

21. The base of claim 16 wherein the holder structure comprises two elongated recesses formed in the base bottom wall, each recess being for friction holding an elongated battery therein, and the mount is positioned to mount the bulb such that a portion of the bulb in a plane which passes through a portion of the at least one battery.

22. The base of claim 21 wherein the mount is positioned such that a portion of the bulb is in a plane which passes through a portion of each battery.

23. The base of claim 22 wherein the mount is positioned to place the bulb along an imaginary line which extends between and beyond the batteries, the bulb being placed on the imaginary line at a point beyond the batteries.

24. The base of claim 22 wherein the mount is positioned beyond one set of ends of the batteries.

25. The base of claim 23 wherein the mount is positioned between the batteries.

26. The base of claim 21, 22, 23, 24 or 25 wherein a conductor includes an elongated wire formed into a loop to mount the bulb therein.

27. The base of claim 16 wherein the side wall has an upper end portion with an interior surface that is disposed at an angle of from about 5° to about 20° outwardly from the vertical, and the side wall upper end portion comprises the support structure.

28. The base of claim 27 wherein the side wall upper end portion is disposed at an angle of about 10° to about 20° outwardly from the vertical.

29. The base of claim 28 wherein the mount is positioned such that a portion of the bulb is in a plane which passes through a portion of each battery.

30. The base of claim 29 wherein the mount is positioned to place the bulb along an imaginary line which extends between and beyond the batteries.

31. The base of claim 16 wherein the base side wall is integral with the base bottom wall, and there is included non-threaded securement structure for securing the base to the container such that the base will reside under the container bottom end portion when the container is lifted.

32. The base of claim 27 wherein the base side wall is integral with the base bottom wall, and there is included securement structure for securing the base to the container such that the base will reside under the container bottom end portion when the container is lifted and the securement structure comprises the angularly-disposed interior surface of the side wall upper end portion.

33. The base of claim 30 wherein the mount is positioned beyond one set of ends of the batteries.

34. The base of claim 33 wherein the holder structure comprises the mount.

35. The base of claim 16 wherein the holder structure comprises first, second and third electrically conductive retainer members mounted on the base bottom wall, each retainer member having an upstanding end wall and, the end walls of the first and second retaining members being juxtaposed to the end wall of the third retaining member for communicating with the opposite ends of and friction holding therebetween two elongated batteries in a spread apart relationship, the first retainer member having an elongated arm extending from the first upstanding end wall and having an end portion in the form of a loop for holding a bulb therein, the second retainer member having an appendage extending from the second upstanding wall, the appendage having a tab which extends under the loop for contacting the bottom of a bulb placed in the loop.

36. The base of claim 35 wherein each retainer member upstanding end wall has a lower end, a foot plate extending therefrom and having attachment structure for attaching the member to the base bottom wall.

37. The base of claim 36 wherein the attachment structure includes at least one aperture defined by a rim and extending through each foot plate, and the base bottom wall holder structure includes a plurality of posts extending upward from the base bottom wall, there being a post for and extending through the aperture of and securely attaching each foot plate to the base bottom wall.

38. The base of claim 37 wherein the posts are made of thermoplastic material and have heads which overlap and engage the rims.

39. The base of claim 38 wherein the first retainer member arm is adapted to position the loop in the space between the batteries.

40. The base of claim 39 wherein the retainer member upstanding end walls each have a bottom edge, and the holder structure includes a groove in the base bottom wall adapted to receive each respective retainer member bottom edge and frictionally hold it in position in its respective groove.

41. The base of claim 40 wherein second retainer appendage and the first retainer arm have bottom edge portions, and the holder structure includes a groove in the base bottom wall adapted to receive the respective appendage and arm, the respective appendage and arm being frictionally held in position in its respective groove.

42. The base of claim 18 wherein when the base is not secured to a container, the loop is positioned at a height such that a bulb will be elevated from and not in contact with the other conductor, but when the base is secured to the container, the container bottom end portion will move the bulb into communication with said other conductor to complete the circuit and illuminate the bulb and container interior.

43. The base of claim 35 wherein the first retainer member arm is adapted to position the loop in the space between the batteries and the base includes securement structure for securing the base to a portion of the container bottom end portion.

44. A base for use with and for illuminating a container for liquids, the container having a side wall and a bottom end portion comprised of a bottom wall at least a portion of which is at least partly transparent to light, the base comprising a main body comprised of an upwardly-disposed side wall whose height is substantially less than that of the container side wall, and a bottom wall, holder structure comprised of first, second and third conductive retainer members for holding two elongated batteries in a substantially horizontal position between the first and second retainer members at one end and the third retainer member at the other end of the batteries, so that the longitudinal axes of the batteries are substantially parallel to the base bottom wall, each retainer member being mounted to the base bottom wall and having at least one upstanding end wall, the at least one end wall of each of the first and second retainer members being juxtaposed to the at least one end wall of the third retainer member for communicating with the opposed ends of and friction-holding therebetween the two elongated batteries in a spaced apart relationship, the first retainer member having an elongated arm extending from the first upstanding end wall and terminating in a loop adapted to mount and hold a bulb therein at least partly in the space between the batteries and in an upward position pointed toward the at least partly transparent portion of the container bottom wall, the second retainer member having an appendage extending from a first upstanding wall, and having a tab which extends under the loop in a position to electrically conductively contact the bottom of a light bulb mounted in the loop, the retainer members being adapted and positioned to be in communication with the batteries and bulb to complete a circuit therebetween and light the bulb, the base side wall having an upper end portion adapted to support the container bottom end portion thereon, whereby the base can illuminate the interior of the container when the container is supported on the base and when an electrical circuit is completed between the batteries and bulb.

45. The base of claim 44 wherein the base includes securement structure for securing the base to the container.

46. The base of claim 44 wherein the side wall upper end portion has an interior surface that is disposed at an outward angle of from about 5° to about 20° to the vertical and the support structure comprises the interior surface of the angularly disposed side wall.

47. The base of claim 44, 45 or 46 wherein the sidewall upper end portion has an interior surface that is disposed at an outward angle of about 10° to about 15° to the vertical and the support structure comprises the interior surface of the angularly disposed-side wall.

48. The base of claim 44 wherein the holder structure formed in the base bottom wall includes two recesses, each recess being spaced from the other and being shaped and sized to receive and hold a battery therein.

49. The base of claim 44 wherein each retaining member upstanding wall has a bottom edge portion and a foot plate extending therefrom, each foot plate has at least one aperture defined by a rim and extending through the foot plate, the base bottom wall has a plurality of posts extending upwardly therefrom, there being a post for and extending through each aperture of and having a head which overlaps and engages the aperture rim to attach the retainer members to the base bottom wall.

50. The base of claim 44 wherein the batteries are two AA batteries in contact with and held by the retainer members, and a light bulb is mounted in the loop to be in contact with the second retainer member tab to illuminate the interior of the container.

51. The base of claim 44 wherein the base includes reflective material for reflecting light to direct it toward the bottom of the container.

52. The base of claim 51 wherein the reflective means includes a conical reflector having a small central aperture and being adapted to be mounted on the loop.

53. The base of claim 44 wherein when the base is not secured to the container, the loop has a linking member associated therewith and the loop is at a height such that a bulb mounted in the loop will be elevated from and will not be in contact with the first retainer member tab, but when the base is secured to the container, the container will contact the linking member and move the loop and bulb so that the bulb will contact with the tab to complete the circuit and illuminate the bulb and container interior.

54. The base of claim 53 wherein the linking member associated with the loop is the bulb.

55. The base of claim 54 wherein the linking member comprises a conical light reflector having a wide upper lip and a central aperture defined by a rim, a portion of the reflector rim is mounted on the loop with the bulb protruding through the reflector aperture.

56. The base of claim 44 wherein each retainer member upstanding wall has a bottom edge portion and the holder structure includes grooves formed in the base bottom wall to receive and frictionally hold the retainer members in position.

57. The base of claim 43 wherein the base sidewall has an upper end portion with an interior surface that is disposed at an angle of from about 5° to about 20° outwardly from the vertical, and the securement structure is a portion of said interior surface of said upper portion of said sidewall.

58. The base of claim 43 wherein the base side wall has an upper end portion that includes an interior surface and includes the securement structure, wherein the securement structure is selected from the group consisting of a portion of said interior surface of the side wall that is outwardly angled from about 5° to about 20° from the vertical, a collar that is integral with the base side wall, and a collar that is secured to the base side wall. a set of threads for threadedly engaging the bottom end portion of the container, and a collar.

59. The base of claim 43 or 58 wherein the mount is positioned to position the bulb such that a portion of the bulb is in a plane which passes through a portion of the at least one battery or of each battery.

60. The base of claim 59 wherein there are two batteries and the mount is positioned to place the bulb at a point along an imaginary line extending between and beyond the batteries.

61. A base for use with and for illuminating a container for liquids, the container having a side wall, a bottom end portion comprised of a bottom wall at least a portion of which is at least partly transparent to light, the base comprising a main body comprised of an upwardly-disposed side wall whose height is substantially less than that of the container side wall, said side wall having an upper end portion with an interior surface, and a bottom wall that is integral with the base side wall, holder structure for holding at least one battery in a substantially horizontal position on the bottom wall so that its longitudinal axis is substantially parallel to a portion of the base bottom wall, a mount for mounting a light bulb in an upward position such that it will point toward the bottom wall of the container when it is supported by the base, conductors for communicating with the bulb and the at least one battery to complete an electrical circuit therebetween to light the bulb, support structure to support the container thereon, and non-threaded securement structure for securing the base to the container such that the base resides under the container bottom end portion when the container is lifted, whereby the base is adapted to illuminate the interior of the container through the container bottom wall when a container is supported by the base and when a circuit is completed between the battery and bulb.

62. The base of claim 61 wherein the interior surface of the upper end portion of the side wall is disposed at an outward angle of about 5° to about 20° from the vertical and comprises the support structure.

63. The base of claim 61 wherein the interior surface of the upper end portion of the sidewall is disposed at an outward angle of about 10° to about 20° from the vertical and comprises the securement structure.

64. The base of claim 61 wherein the outwardly-angled interior portion of the sidewall comprises the support structure and the securement structure.

65. The base of claim 61 or 62 wherein the angle is about 10° to about 15°.

66. The base of claim 61 or 64 wherein the mount is positioned to position the bulb such that a portion of the bulb is in a plane which passes through a portion of the at least one battery.

67. The base of claim 66 wherein there are two batteries and the mount is positioned to place the bulb at a point along an imaginary line extending between and beyond the batteries, said bulb being placed on said imaginary line at a point beyond the batteries.

68. The base of claim 11 wherein the securement structure comprises an upwardly extending member which extends from and above the base side wall and associates with the container to secure or assist in securing the base to the container.

69. The base of claim 31, 32, 35, 46, 61, 62 or 63 wherein the securement structure comprises an upwardly extending member which extends from and above the base side wall and associates with the container to secure or assist in securing the base to the container.

70. The base of claim 68 wherein the upwardly extending member is selected from the group consisting of a handle, a handle with a finger, a hook which hooks over a handle on the container, and an upwardly extending member with arms which extend about the container side wall.

71. The base of claim 69 wherein the upwardly extending member is selected from the group consisting of a handle, a handle with a finger, a hook which hooks over a handle on the container, and an upwardly extending member with arms which extend about the container side wall.

72. The base of claim 31, 32, 35, 61 or 62 wherein the securement structure comprises a collar, said collar being integral with the upper end portion of the base side wall and being biased inwardly to frictionally fit over and secure the base to the bottom end portion of a container.

73. The base of claim 35 or 44 wherein each retainer member end wall has a side and bottom edge portion which is arcuately shaped.

74. The base of claim 73 wherein the base bottom wall includes a recessed panel portion defined by an upstanding wall, and the holder structure includes grooves, each having a portion which is offset into a portion of the upstanding wall and adapted to receive and frictionally hold one or more of the retainer member end walls therein.

75. The base of claim 74 wherein the holder structure comprises two elongated recesses formed in the base bottom wall recessed panel portion and positioned parallel to and spaced from each other, each for seating a battery therein, the upstanding wall is comprised of side walls, one alongside one recess and the other alongside the other recess, and of end walls, one at each end of the recesses, and there is at least one groove in each end wall.

76. The base of claim 75 wherein the inside surface of each upstanding sidewall is positioned relative to its adjacent recess to engage and help hold a battery when it is seated in the recess.

77. The base of claim 74 wherein the base includes securement structure for securing the base to a portion of the container bottom end portion.

78. The base of claim 75 wherein there is at least one elevated panel portion between the two recesses.

79. The base of claim 78 wherein the at least one elevated portion has a top surface adapted to support a portion of the first retainer member arm.

80. The base of claim 79 wherein there are two axially aligned elevated portions positioned between the recesses, and there is a space between the elevated portions for positioning a portion of the mount, and the second retainer member tab in said space.

81. A base for use with and for illuminating a container for liquids, the container having a side wall and a bottom end portion comprised of a bottom wall at least a portion of which is at least partly transparent to light, the base comprising a main body comprised of an upwardly-disposed side wall whose height is substantially less than the height of the container side wall, and a bottom wall having a recessed panel defined by an upstanding wall, said panel having two spaced axially aligned elevated portions, holder structure comprised of two elongated recesses in the base bottom wall recessed panel portion positioned parallel to and spaced from each other, each for seating a battery therein, the bottom wall elevated portions being located between said recesses, and, first, second and third conductive retainer members for holding two elongated batteries in a substantially horizontal position between the first and second retainer members at one end and the third retainer member at the other end of the batteries, so that the longitudinal axes of the batteries are substantially parallel to the base bottom wall, each retainer member being mounted in a groove formed in a portion of the base bottom wall and having at least one upstanding end wall, each said end wall in turn having an arcuately shaped side and bottom edge portion, the at least one end wall of each of the first and second retainer members being juxtaposed to the at least one end wall of the third retainer member for communicating with the opposed ends of and friction-holding therebetween the two elongated batteries in a spaced apart relationship, the first retainer member having an elongated arm extending from a side edge of its end wall and terminating in a loop adapted to mount and hold a bulb therein at least partly in the space between the batteries and the bottom wall elevated portions, and in an upward position pointed toward the at least partly transparent portion of the container bottom wall, such that a portion of the bulb is in a plane which passes through a portion of each battery, the second retainer member having an appendage extending from an edge of its end wall, and having a tab which extends under the loop in a position to electrically conductively contact the bottom of a light bulb mounted in the loop, the retainer members being adapted and positioned to be in communication with the batteries and bulb to complete a circuit therebetween and light the bulb, the base side wall having an upper end portion disposed at an angle of about 10° to 15° outward from the vertical and adapted to support the container bottom end portion thereon, whereby the base can illuminate the interior of the container when the container is supported on the base and when an electrical circuit is completed between the batteries and bulb.

82. The base of claim 45 wherein the base sidewall has an upper end portion with an interior surface that is disposed at an angle of from about 5° to about 20° outwardly from the vertical, and the securement structure is a portion of said interior surface of said upper portion of said sidewall.

83. The base of claim 45 wherein the base side wall has an upper end portion that includes an interior surface and includes the securement structure, wherein the securement structure is selected from the group consisting of a portion of said interior surface of the side wall that is outwardly angled from about 5° to about 20° from the vertical.

84. The base of claim 31, 32, 35, 61 or 62 wherein the securement structure comprises a collar that is secured to the upper end portion of the base side wall and is biased inwardly to frictionally fit over and secure the base to the bottom of the container.

* * * * *